US005599020A

United States Patent [19]

Fields

[11] Patent Number: 5,599,020

[45] Date of Patent: Feb. 4, 1997

[54] FORTUNE TELLING GAME USING CARDS

[76] Inventor: Sandra Fields, 12 Longwoods La., E. Hampton, N.Y. 11937

[21] Appl. No.: 420,742

[22] Filed: Apr. 12, 1995

[51] Int. Cl.[6] ..... A63F 9/18

[52] U.S. Cl. ..... 273/161; 273/308

[58] Field of Search ..... 273/153 R, 157 R, 273/161, 292, 302, 308

[56] References Cited

U.S. PATENT DOCUMENTS

| | | | |
|---|---|---|---|
| 142,075 | 8/1873 | Billings | 273/161 |
| D. 269,921 | 8/1983 | Young, Jr. et al. | 273/308 |
| 2,034,991 | 3/1936 | Salinger | 273/308 |
| 3,970,315 | 7/1976 | Redner | 273/161 |
| 4,583,737 | 4/1986 | Falcone et al. | 273/161 |
| 4,934,708 | 6/1990 | Kolkind | 273/243 |

*Primary Examiner*—Steven B. Wong

*Attorney, Agent, or Firm*—Notaro & Michalos

[57] ABSTRACT

A deck of fortune telling cards and method of playing a fortune telling game includes multiple people cards which depict people of different genders and age ranges. A person whose fortune is to be told is identified with one of the cards by writing the person's name on the card. The deck includes internal condition cards which depict different human conditions including emotions and attitudes. Quantity cards which indicate measurements of time and distance are included as are relationship cards which depict different human relationships. External influence cards depict different external influences such as good or bad news. Action cards such as advice, help/assistance, review carefully, talking it over, fixing it, and the like and result cards such as recognition/success/reward, good legal and the like, are also present. A question card having an area on which a question can be depicted or written is also included in case the fortune telling game is to be used for answering a question in an entertaining manner.

3 Claims, 25 Drawing Sheets

ADVICE

Help/Assistance

REVIEW CAREFULLY

Talking it over

SOMETHING ENDING

CHANGING DIRECTIONS
VIEWPOINTS/GOALS old situation
from the past

CAREER/BUSINESS/ENTERPRISE
(GOOD OR NEW)

CHANGE OF HOME/CAREER/PLACE

Vacation/leisure

TRAVEL

Fertility-Pregnancy
A new idea

NEW OPPORTUNITY-
ANOTHER CHANCE

LIBERATION/
FREEDOM

RETREATING

MARRIAGE AND/OR
COMMITMENT

SOCIALIZING/
GOING OUT/A DATE

ENTERTAINMENT/
HOSPITALITY

CELEBRATION
PARTY

Reunion

FORTUNE TELLING GAME USING CARDS

FIELD AND BACKGROUND OF THE INVENTION

The present invention relates, in general, to games, and in particular, to a new and useful fortune telling game which is used in conjunction with a deck of cards that carry images and words depicting various human conditions, situations, results, people and the like.

An entertaining technique of fortune telling called Tarot cards has been known for thousands of years. The cards each carries images. The deck of cards is shuffled and then exposed to tell a person's fortune in an entertaining manner which may also be informative and raise a person's self-awareness. The Tarot cards also, however, have a strong element of foreboding and are impersonal and vague, with little direct connection between the individual whose fortune is being told, and the images on the cards. The Tarot cards cannot be read and understood until one reads and studies their meaning. Unlike the present invention, they are not self-explanatory.

While the present invention uses cards, as does the Tarot, there is no correlation between the Tarot and the new game, except the idea of telling the future.

SUMMARY OF THE INVENTION

An object of the present invention is to provide an entertaining fortune telling game which is based on cards and which draws direct connections between the person whose fortune is being told or whose question is being answered, and the cards themselves.

According to the present invention, a multiplicity of cards in the deck include a plurality of so-called "people cards" which have images of people of different genders, different hair or skin coloring, looks and ages, and in different postures which, through body language, depict different characteristics. Some of the people cards include words which identify the category, such as "young man" or "young woman". Others do not include such words but rely on the image alone. A blank space is provided on the card in which one can write a name identifying the person who will participate in the game or whose fortune or question will be answered in an entertaining manner, using the game.

In addition to these personalized cards, a large number of additional cards depict images and words identifying various human conditions or relationships such as a "happy couple" card, a "family/friends" card, and broader human condition cards such as "love/happiness" and "reliability/stable/just". Further, to give the game the aura of accuracy, time cards are included which depict different time periods such as "in the near future", "within the next 6 months" and "within the year". Proximity cards are also included such as "a long distance away" and "close to home", again to give a quantitative aspect to the game.

Among the human condition cards, more specific emotion cards are included such as "fear/anxiety", "anger", and more general cards such as "chaotic emotions".

In addition, among the cards are action cards which tell a person of a particular action and which can be used in divining additional meaning from the cards. Among these are an "advice" card, a "help/assistance" card, a "talking it over" card, and the like.

Additional cards depict external influences such as "something ending", "something unexpected" and "old situation from the past" cards are included in the deck.

Result cards like "victory/good outcome", "change of home/career/place" are included. The "question to be answered" card can be very personalized by writing in a question.

In addition to using the deck of cards, the invention includes a process for conducting the fortune telling session or game which further enhances the images, concepts, actions, emotions, conditions, results and insights provided by the cards.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1, standing, light-haired complexion woman;

FIG. 100, "THE QUESTION IS".

DESCRIPTION OF THE PREFERRED EMBODIMENT

Figure 1:
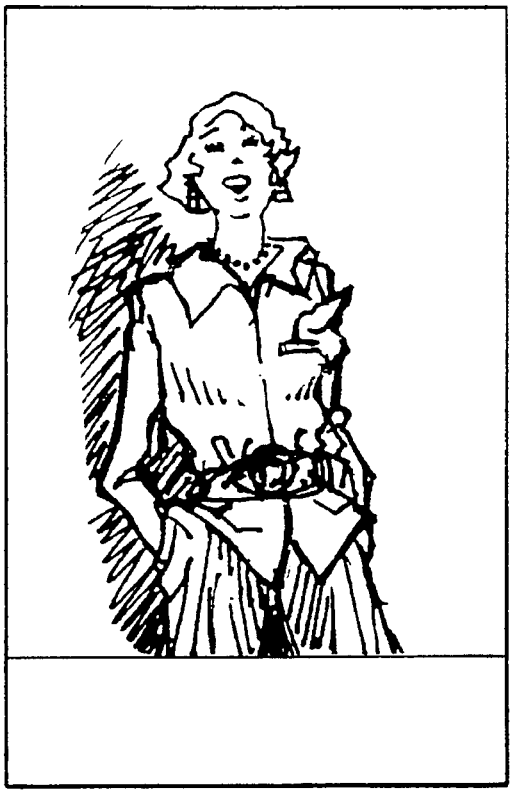
FIGS. 1–100 are respective plan views of the 100 cards used in the preferred embodiment of the invention, and identified as follows.
Figure 2:
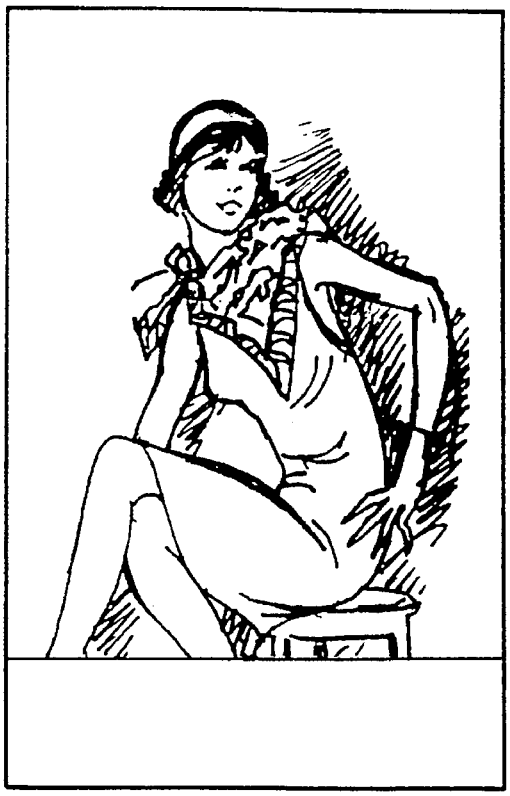
FIG. 2, sitting, medium-haired complexion woman.
Figure 3:
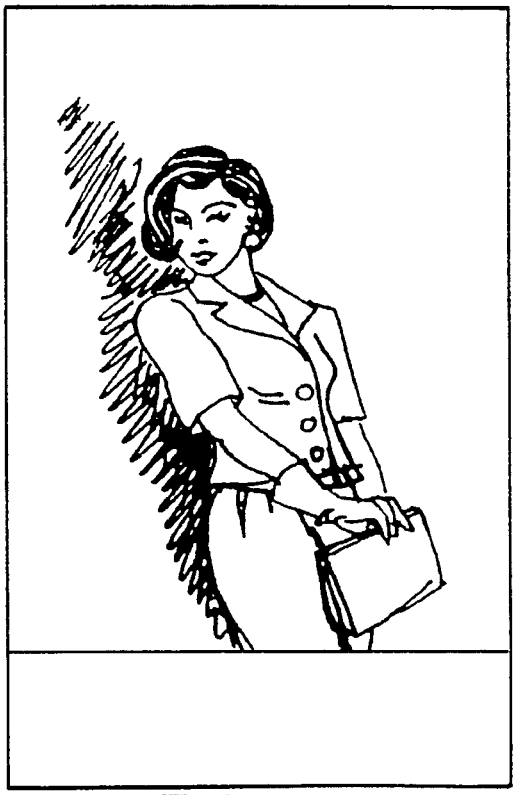
FIG. 3, standing, medium-haired complexion woman.
Figure 4:
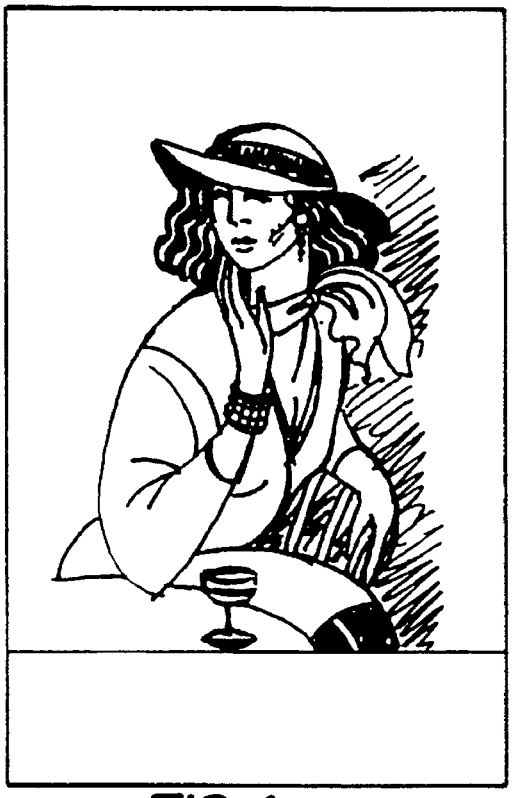
FIG. 4, sitting, dark-haired complexion woman.
Figure 5:
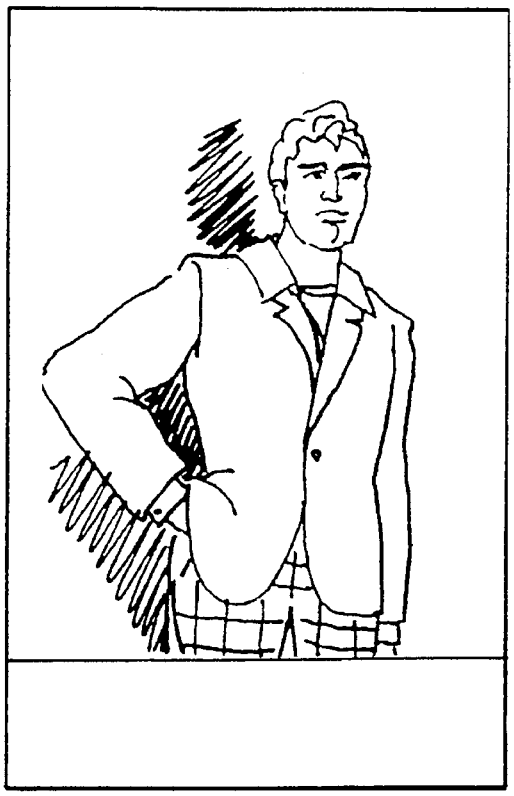
FIG. 5, standing, light-haired complexion man.
Figure 6:
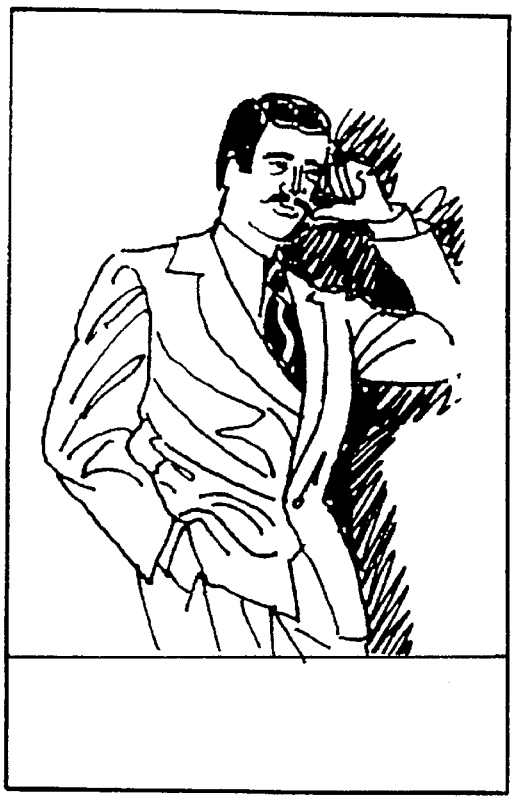
FIG. 6, standing man with dark-haired complexion in thought.
Figure 7:
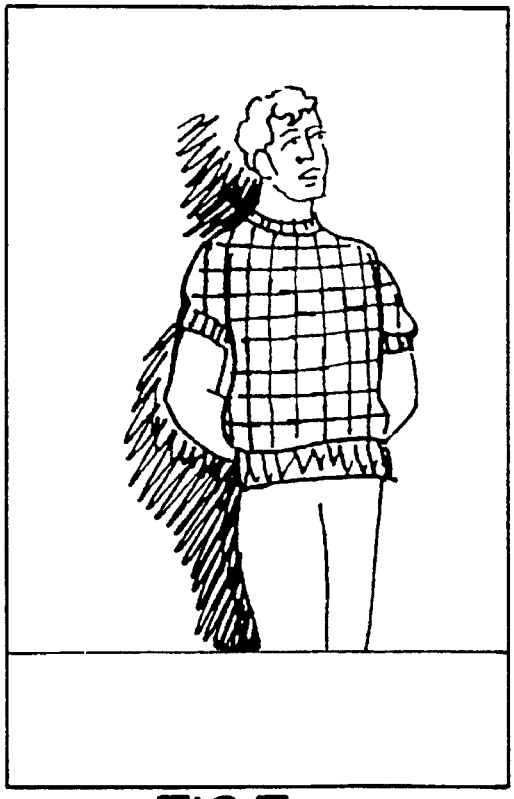
FIG. 7, standing man with medium-haired complexion.
Figure 8:
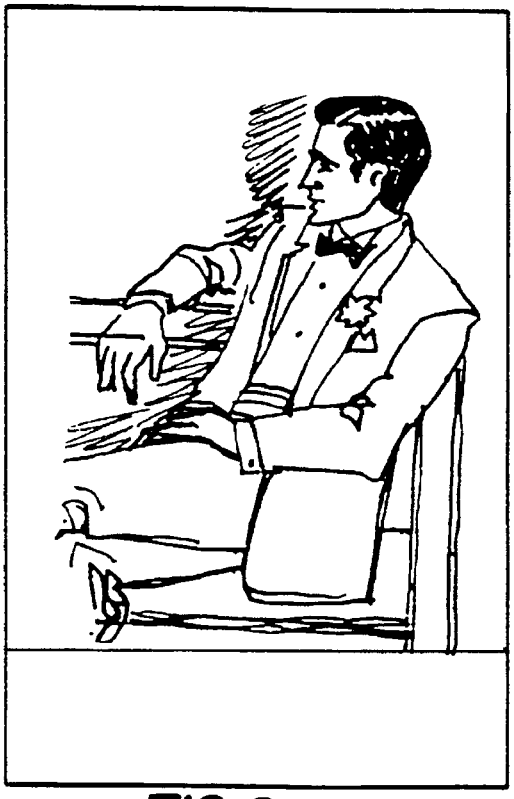
FIG. 8, sitting dark-haired complexion man.
Figure 9:
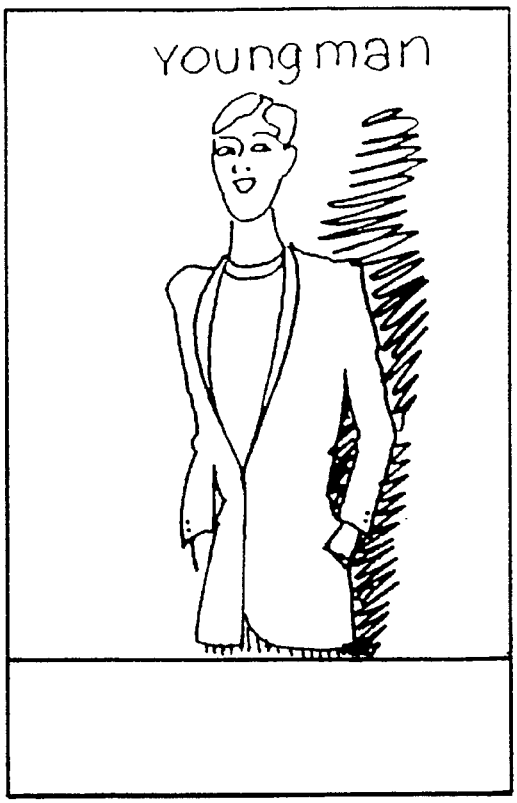
FIG. 9, "YOUNG MAN" standing with light-haired complexion.
Figure 10:
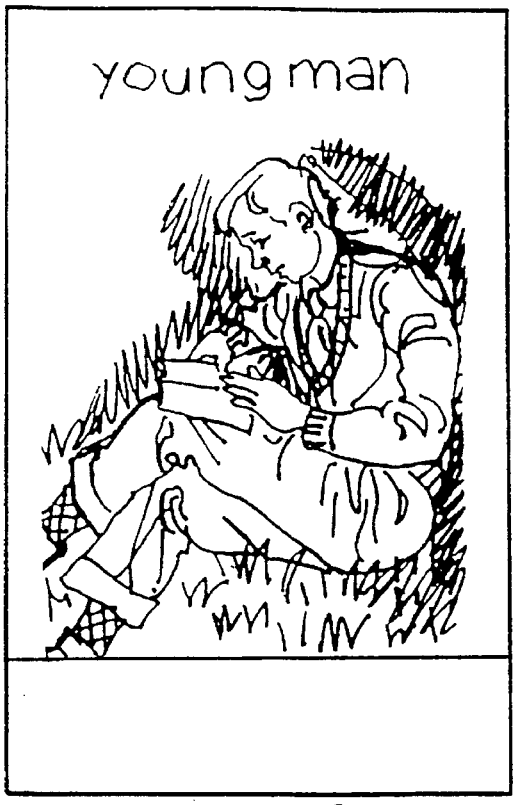
FIG. 10, "YOUNGMAN" sitting with.dark-haired complexion.
Figure 11:
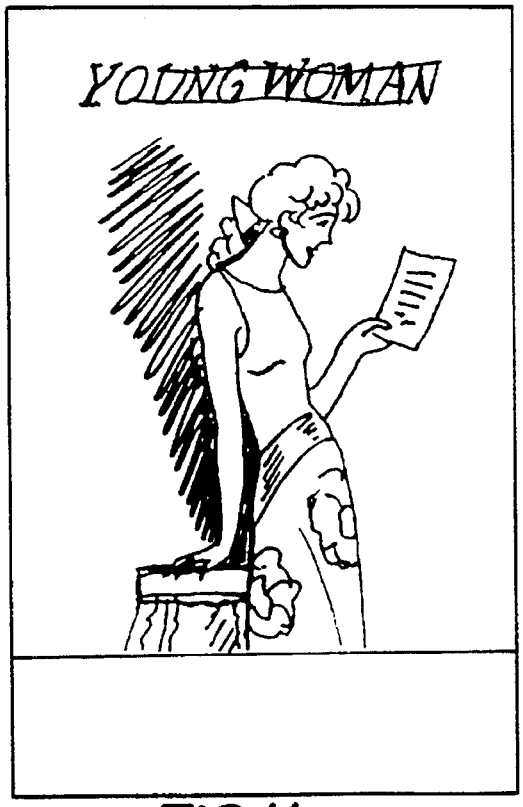
FIG. 11, "YOUNG WOMAN" with light-haired complexion.
Figure 12:
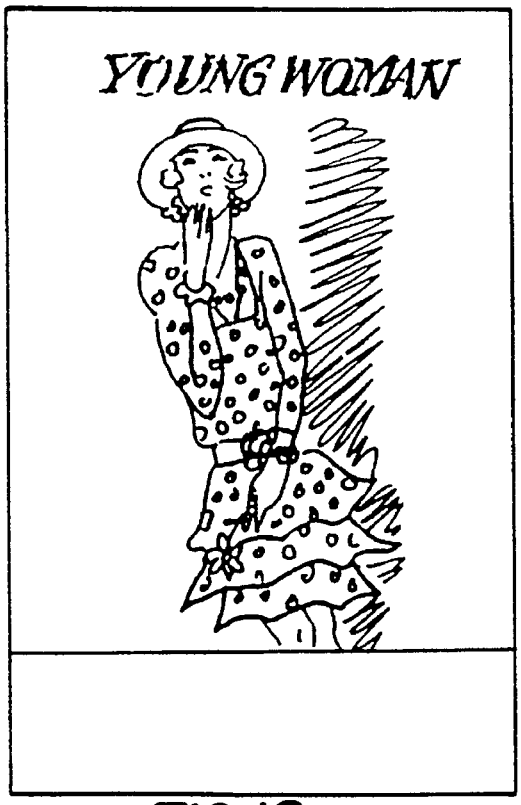
FIG. 12, "YOUNG WOMAN" standing with dark-haired complexion.
Figure 13:
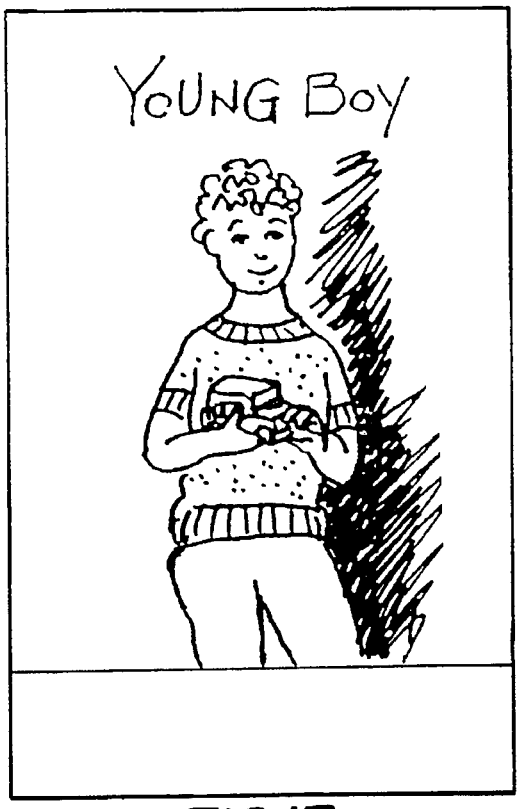
FIG. 13, "YOUNG BOY" standing with toy with lighter-hair.
Figure 14:
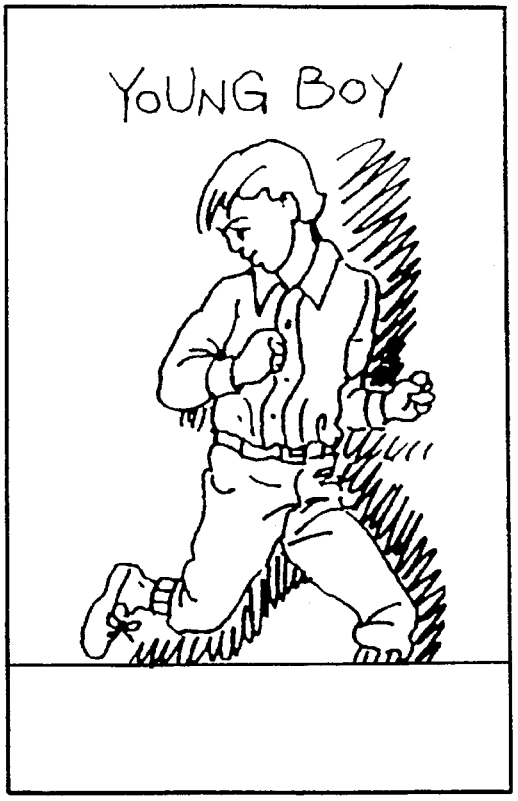
FIG. 14, "YOUNG BOY" running with darker hair.
Figure 15:
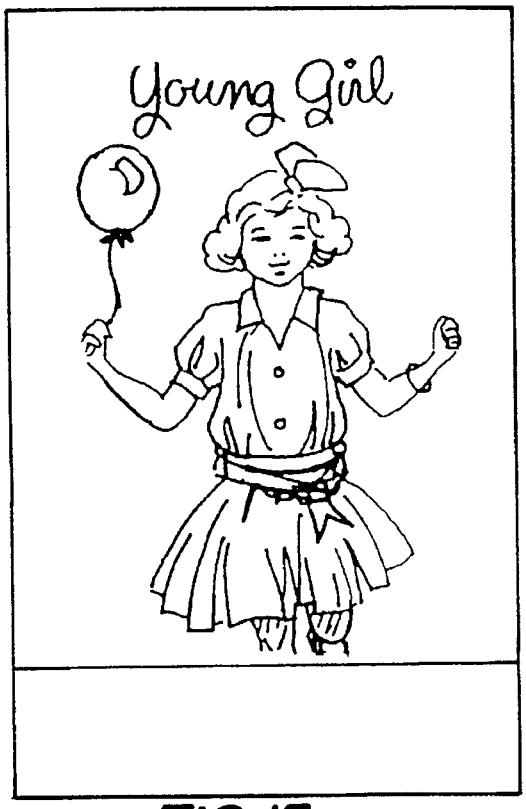
FIG. 15, "YOUNG GIRL" with a balloon and active.
Figure 16:
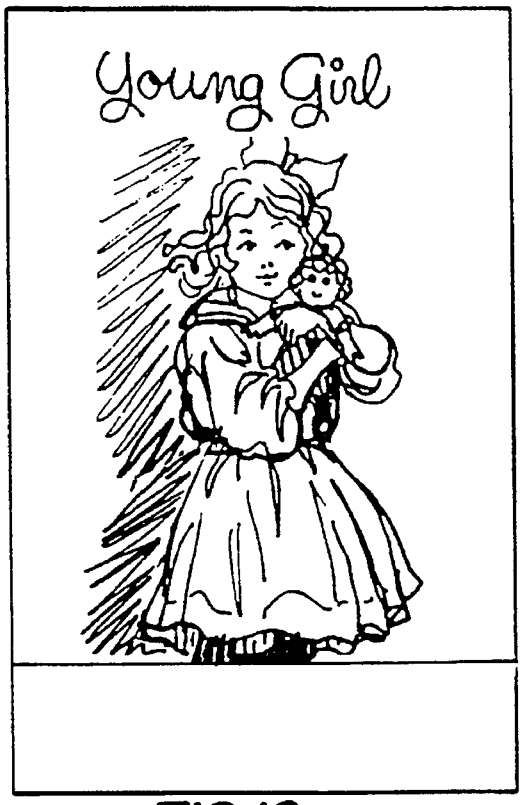
FIG. 16, "YOUNG GIRL" with doll and calm.
Figure 17:
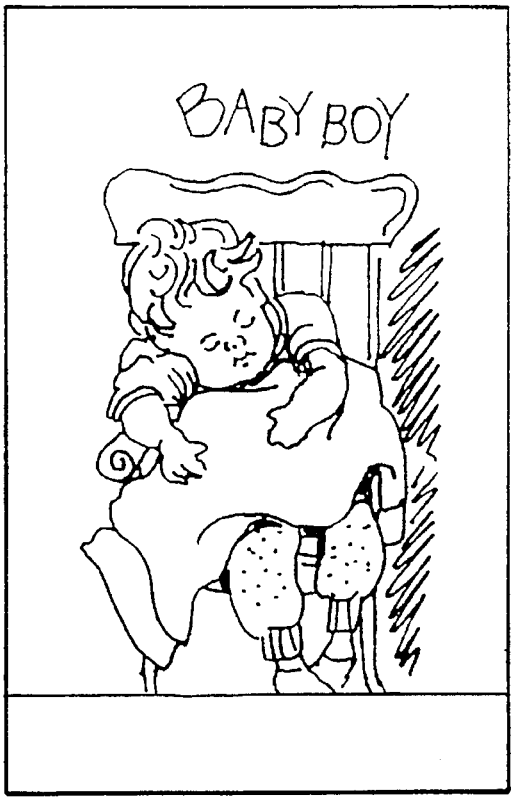
FIG. 17, "BABY BOY" sleeping.
Figure 18:
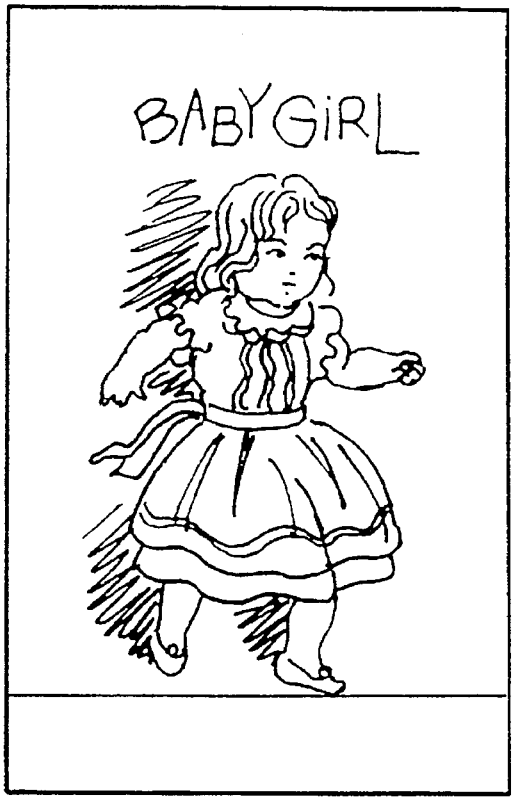
FIG. 18, "BABY GIRL" standing.
Figure 100:
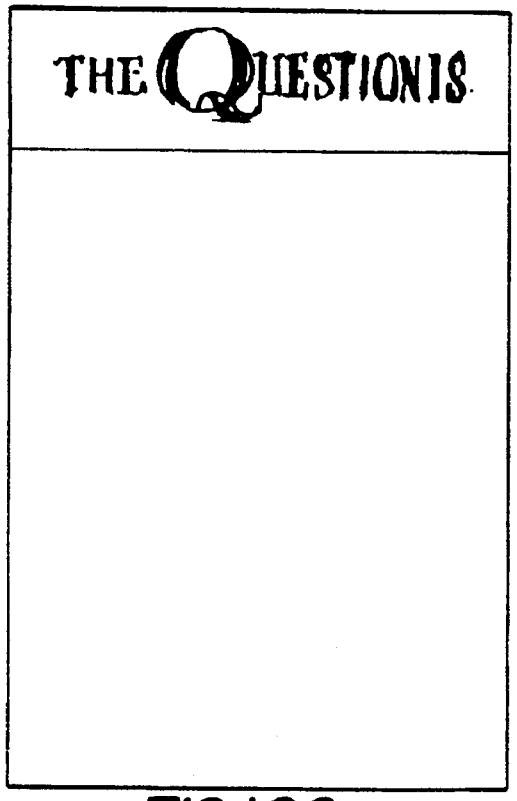

There are 100 cards in the game, shown in FIGS. 1–100, respectively. There are 18 "PEOPLE CARDS", FIGS. 1–18, with a blank space on the bottom to write in an individual's name, that can be erased. One may include as many people cards in the game as one wishes. A person's name need not be put on the cards, nor must all the people cards be used or all people playing the game have a card.

Figure 19:
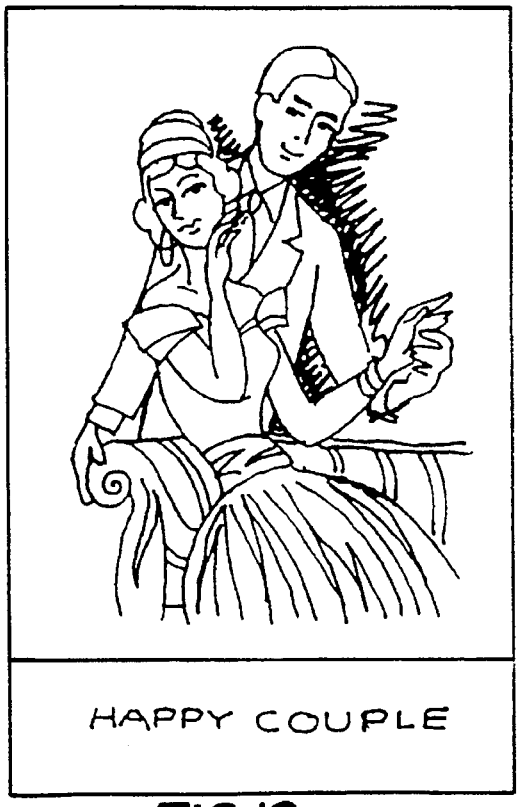
FIG. 19, "HAPPY COUPLE"
Figure 20:
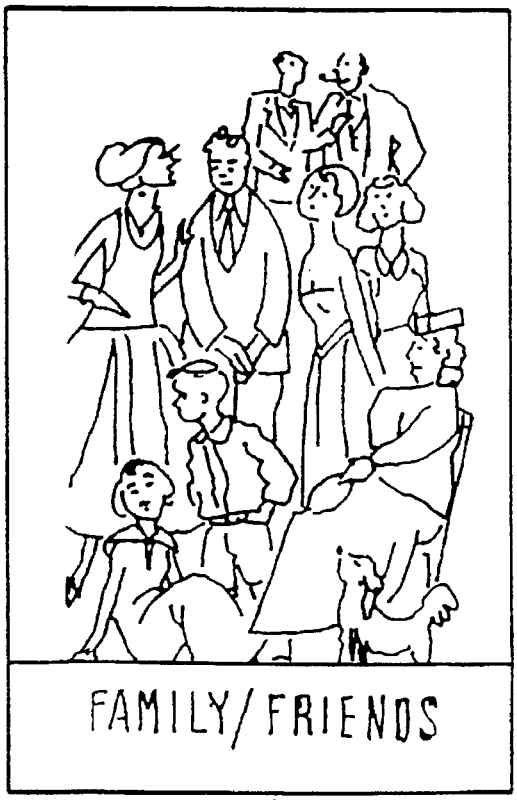
FIG. 20, "FAMILY/FRIENDS"

FIGS. 19 and 20 each show a group card, indicating groupings of people, such as a happy couple or family or friends.

Figure 21:
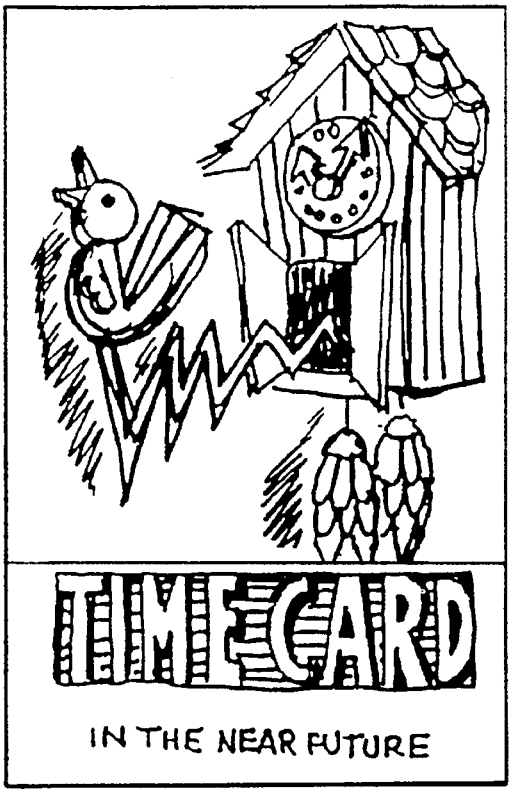
FIG. 21, "TIME CARD" in the near future.
Figure 22:
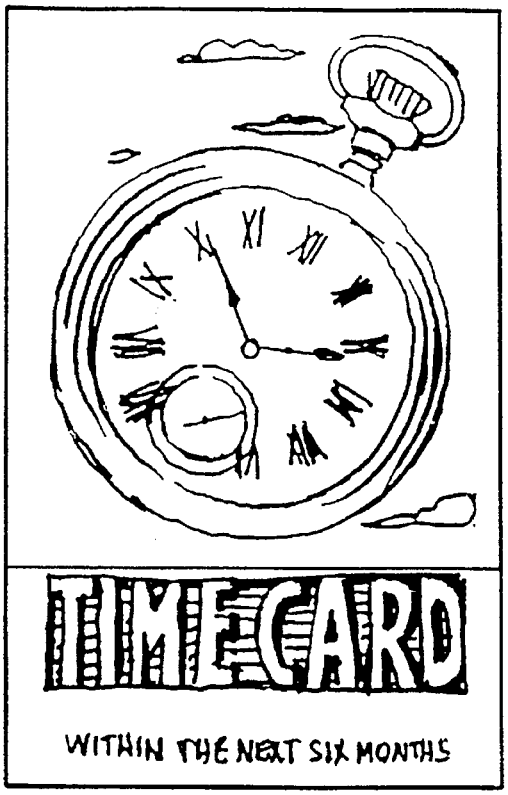
FIG. 22, "TIME CARD" within the next six months.
Figure 23:
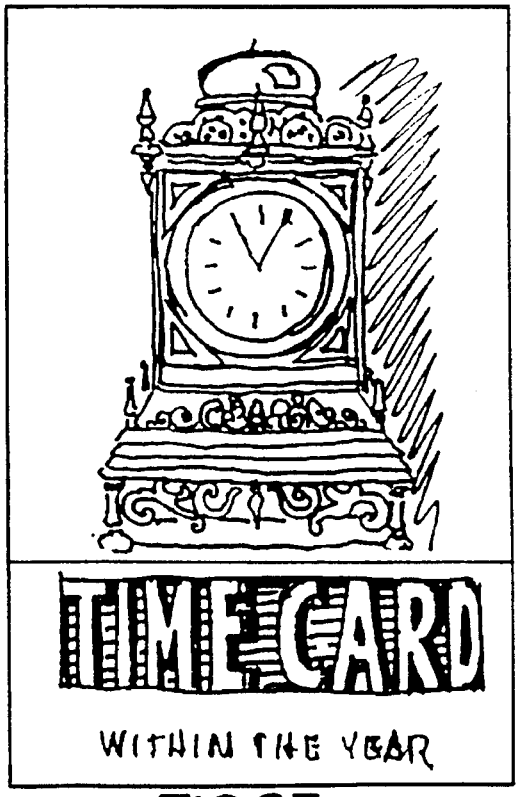
FIG. 23, "TIME CARD" within the year.

There are three timing cards, FIGS. 21, 22 and 23, that are mixed into the deck that may or may not come up as one chooses cards from the deck.

There is one blank card, FIG. 100, that says "THE QUESTION IS?". This card is blank to leave room for a question that has to be answered as part of the game or fortune telling session.

Figure 24:
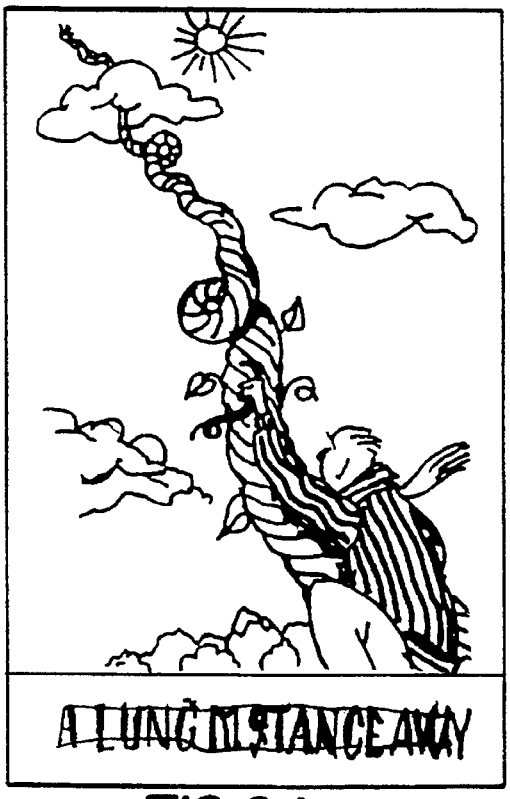
FIG. 24, "A LONG DISTANCE AWAY"
Figure 25:
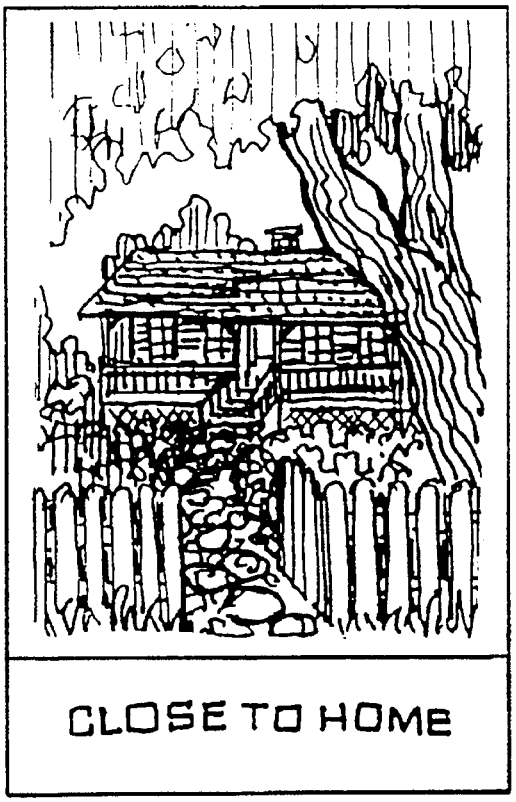
FIG. 25, "CLOSE TO HOME"
Figure 26:
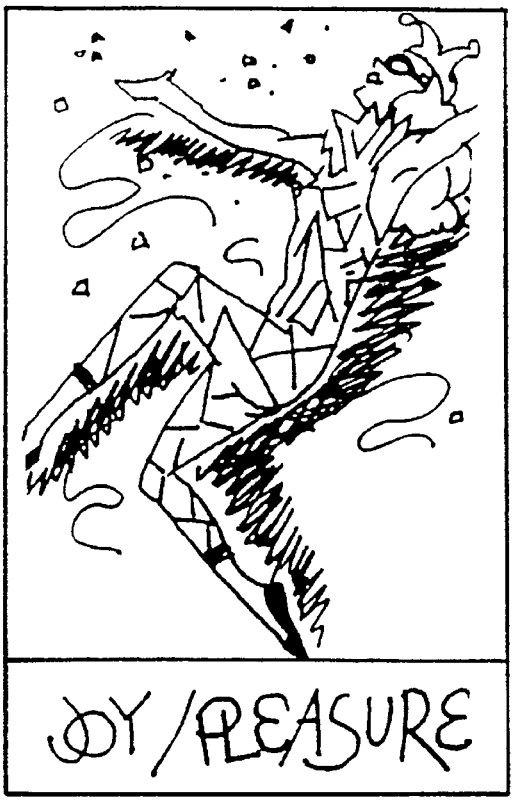
FIG. 26, "JOY/PLEASURE"
Figure 27:
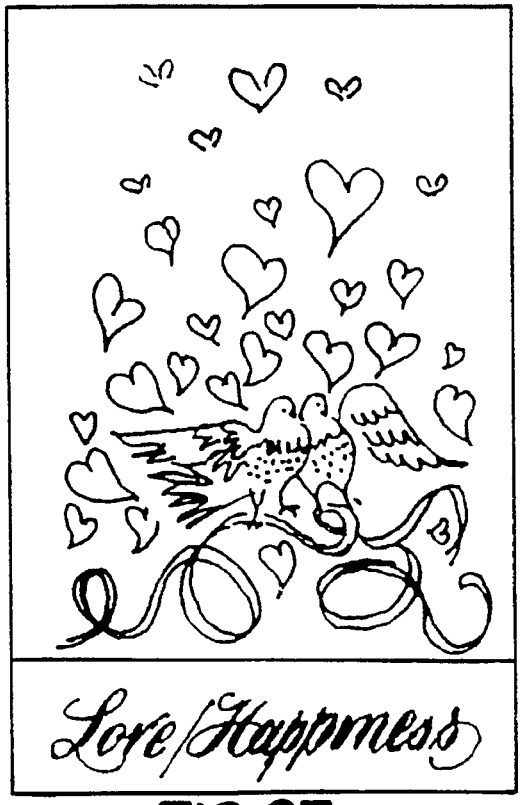
FIG. 27, "LOVE/HAPPINESS"
Figure 28:
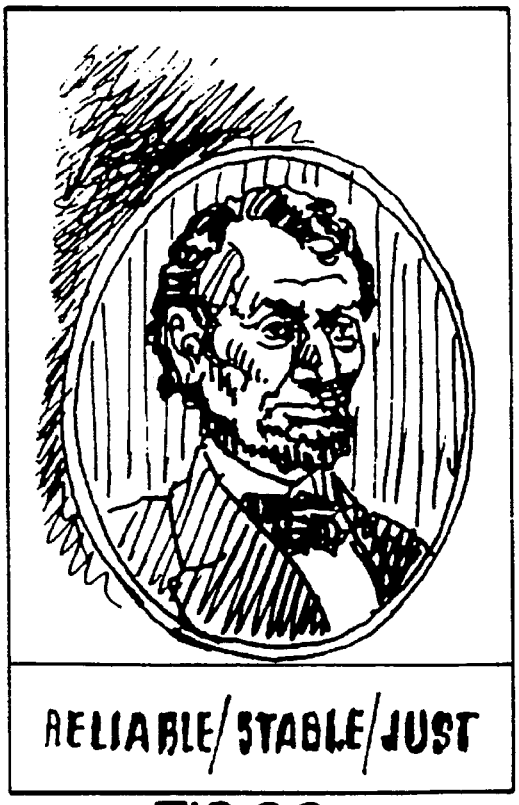
FIG. 28, "RELIABLE/STABLE/JUST"
Figure 29:
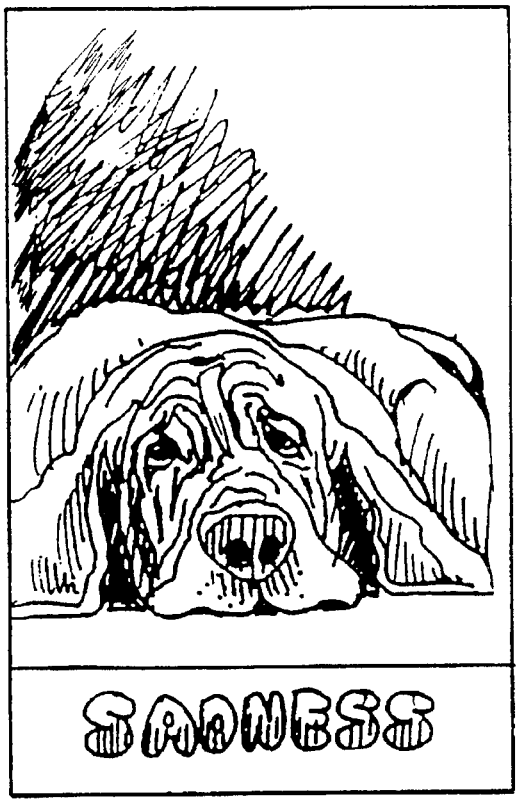
FIG. 29, "SADNESS"
Figure 30:
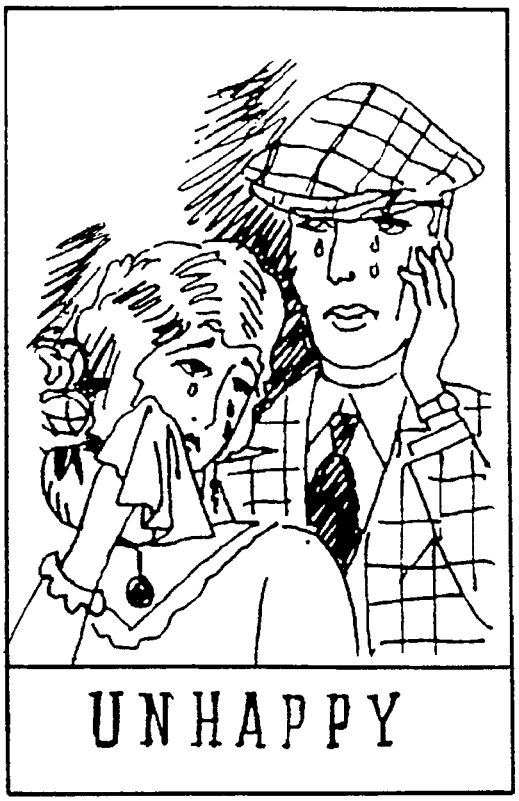
FIG. 30, "UNHAPPY"
Figure 31:
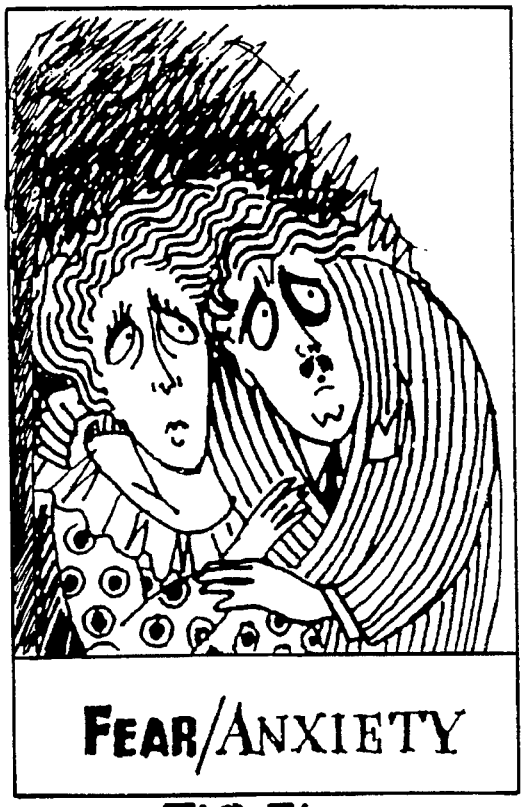
FIG. 31, "FEAR/ANXIETY"
Figure 32:
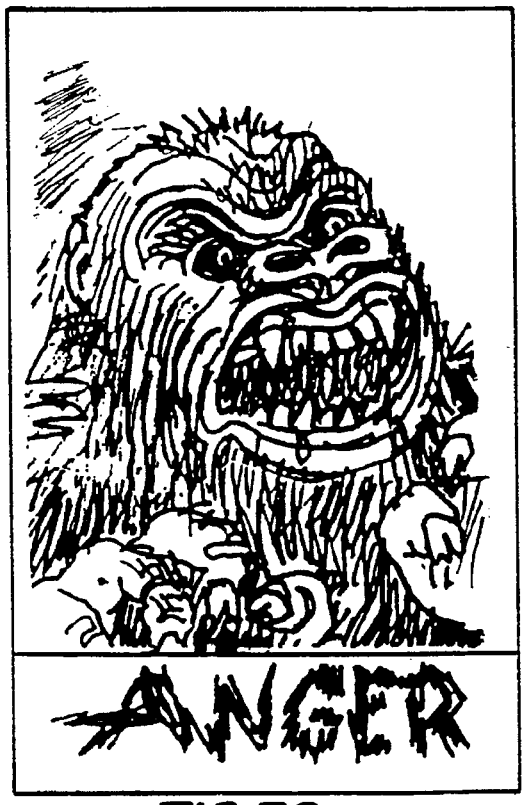
FIG. 32, "ANGER"
Figure 33:
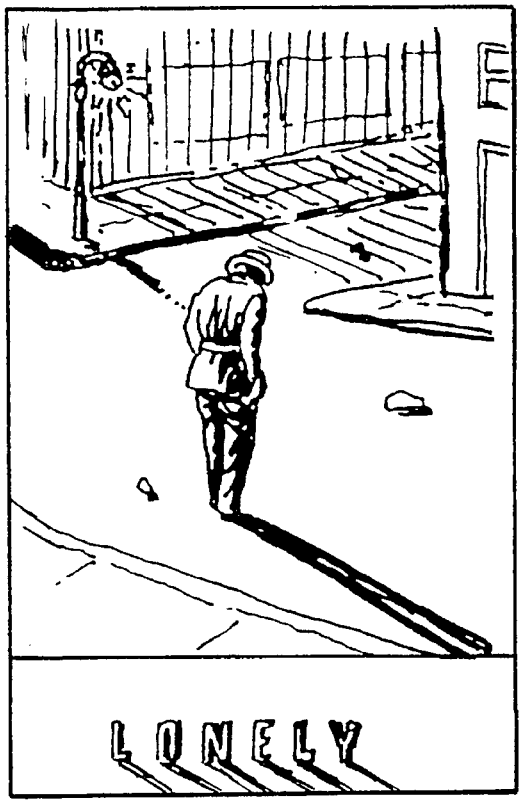
FIG. 33, "LONELY"
Figure 34:
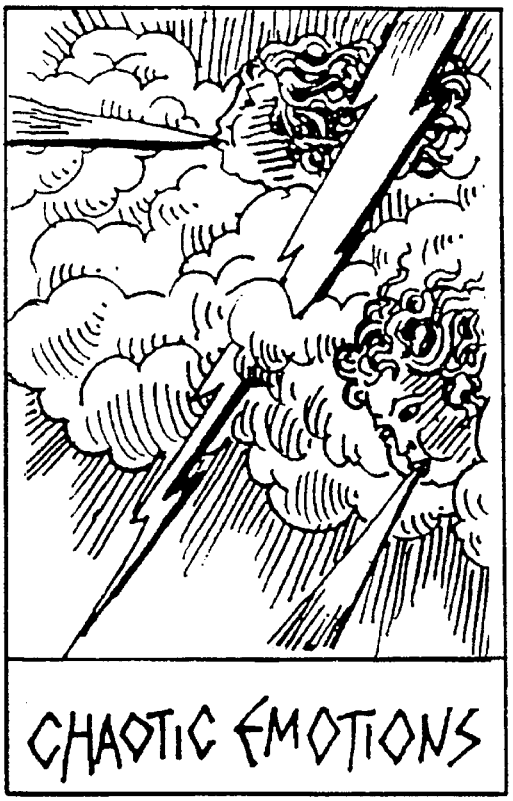
FIG. 34, "CHAOTIC EMOTIONS"
Figure 35:
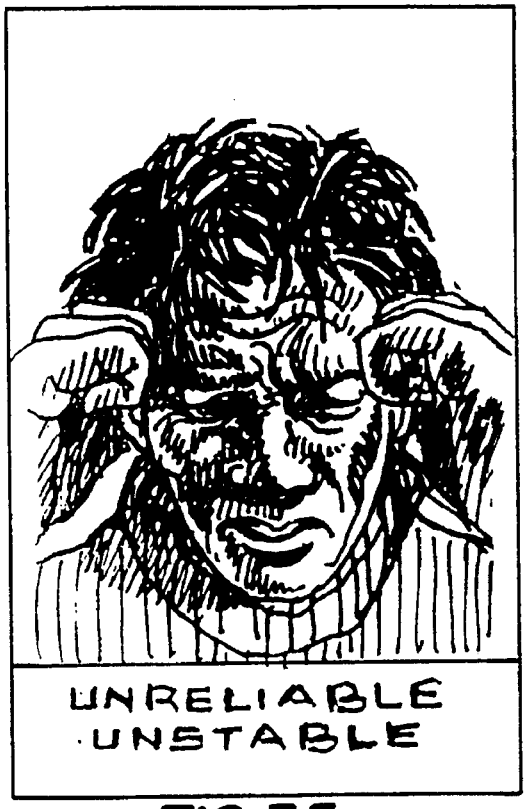
FIG. 35, "UNRELIABLE/UNSTABLE"
Figure 36:
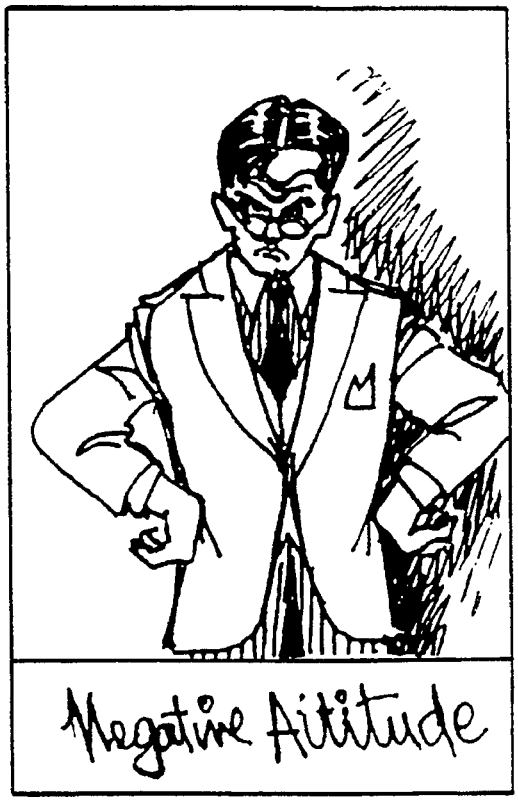
FIG. 36, "NEGATIVE ATTITUDE"
Figure 37:
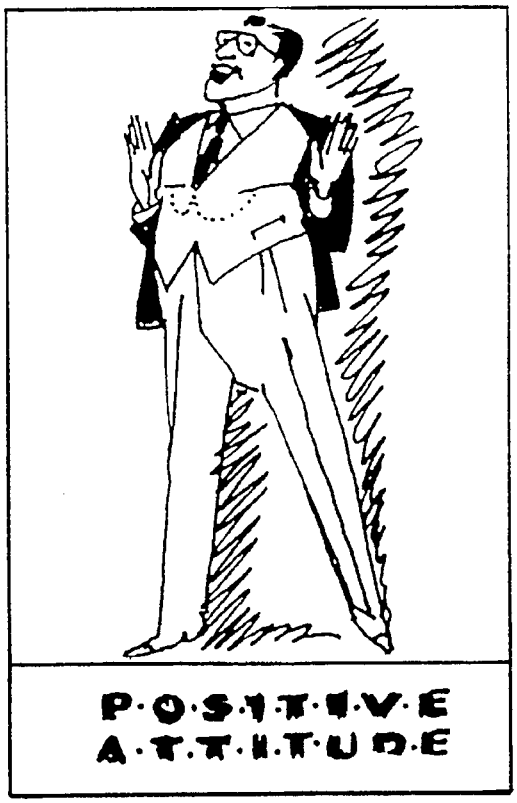
FIG. 37, "POSITIVE ATTITUDE"
Figure 38:
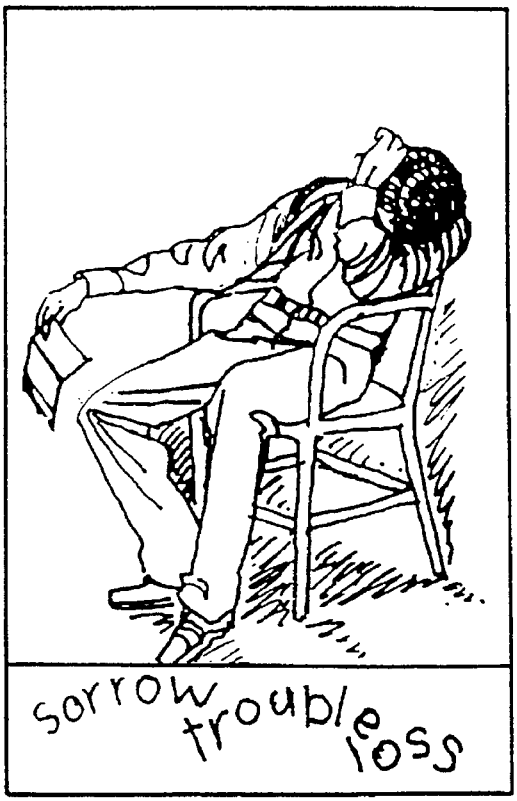
FIG. 38, "SORROW/TROUBLE/LOSS"
Figure 39:
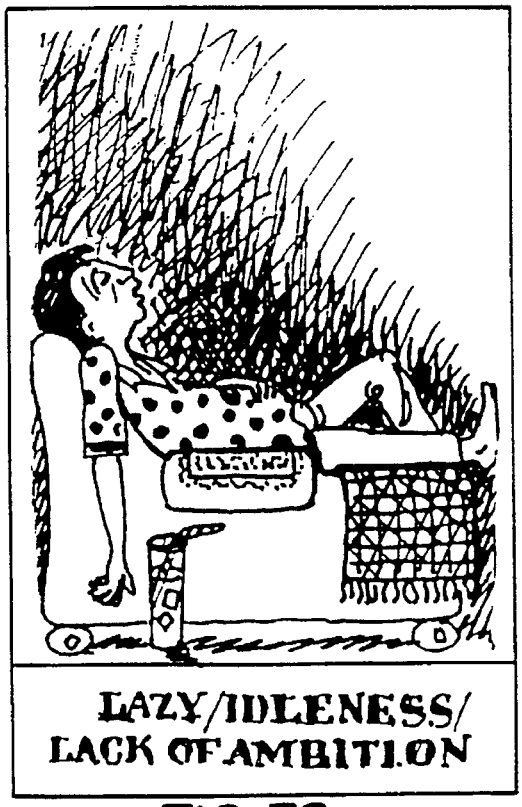
FIG. 39, "LAZY/IDLENESS/LACK OF AMBITION" (action)
Figure 40:
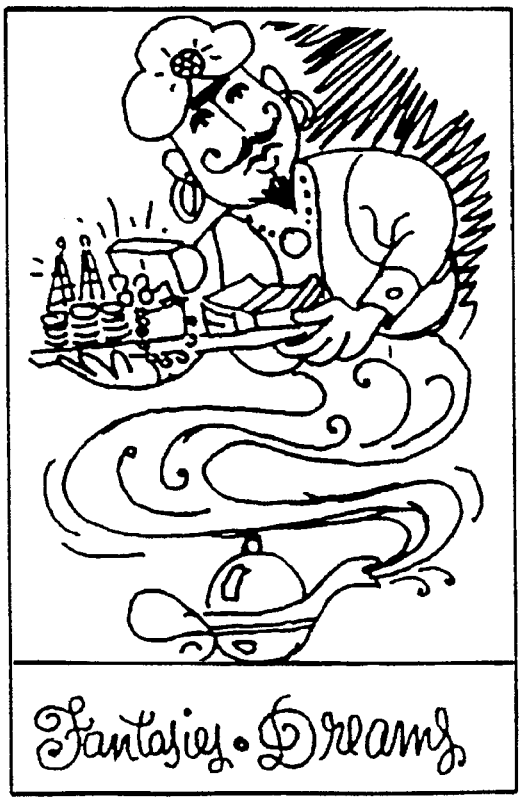
FIG. 40, "FANTASIES/DREAMS"
Figure 41:
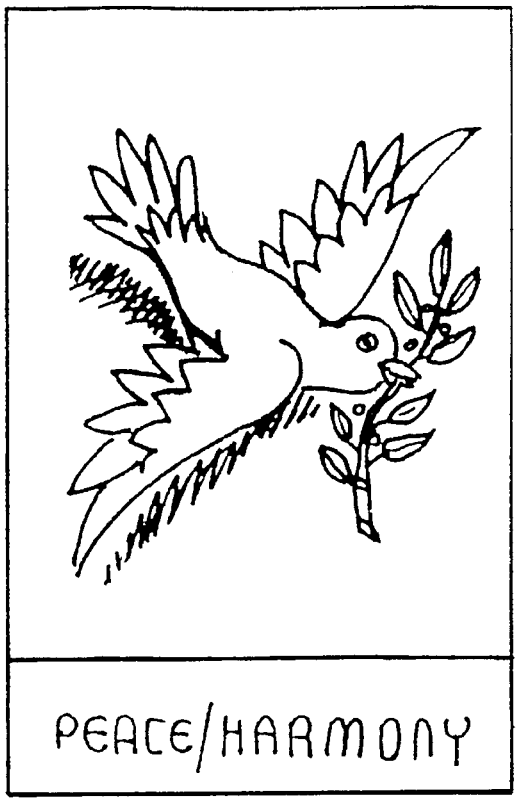
FIG. 41, "PEACE/HARMONY"
Figure 42:
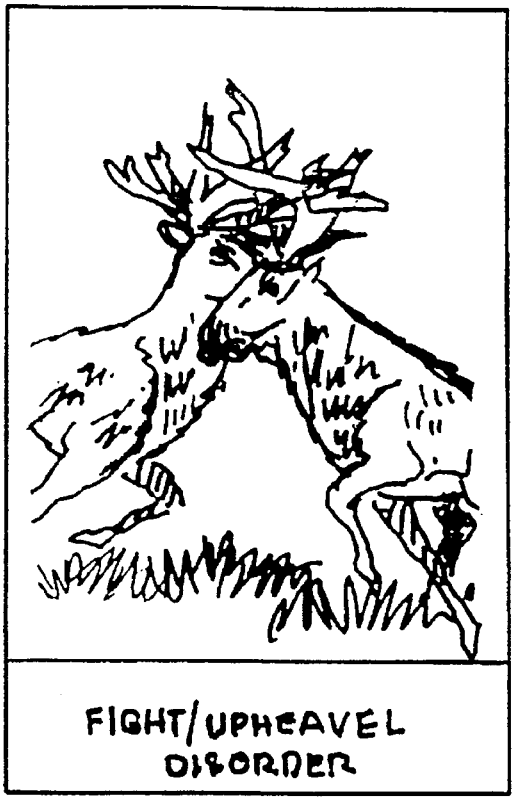
FIG. 42, "FIGHT/UPHEAVAL/DISORDER"
Figure 43:
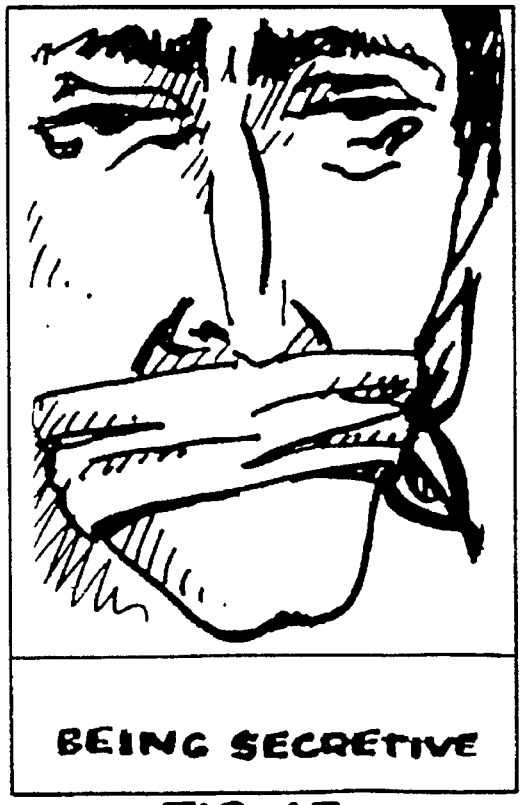
FIG. 43, "BEING SECRETIVE" (emotion and action)
Figure 44:
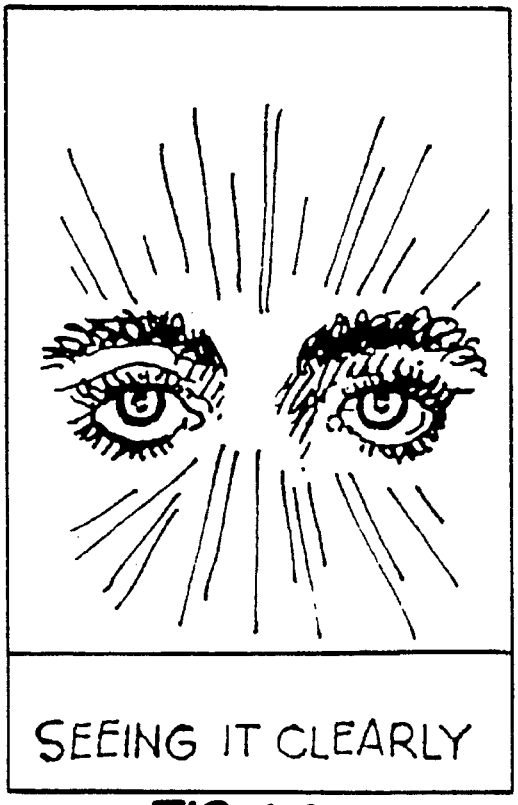
FIG. 44, "SEEING IT CLEARLY"
Figure 45:
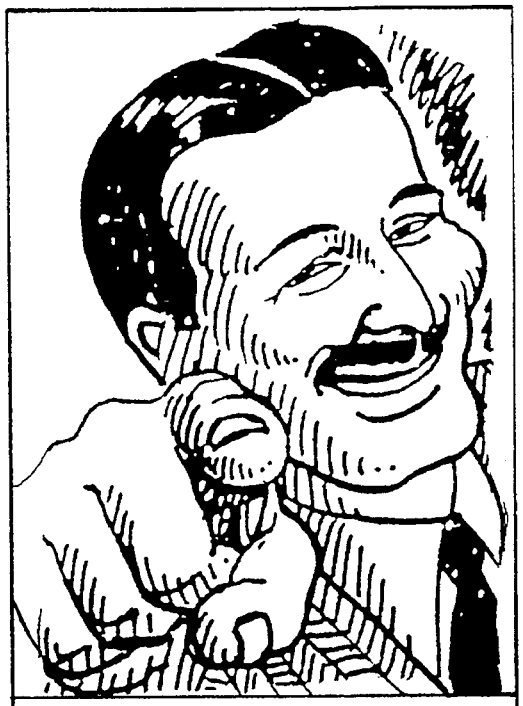
FIG. 45, "ADVICE" (action)
Figure 46:
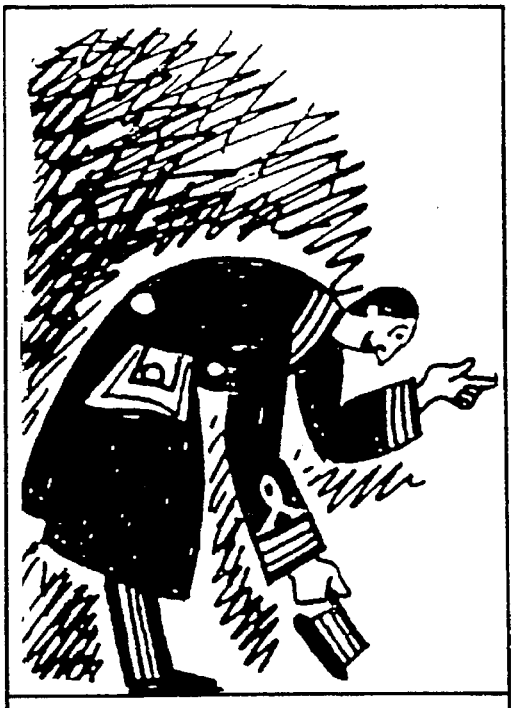
FIG. 46, "HELP/ASSISTANCE" (action)
Figure 47:
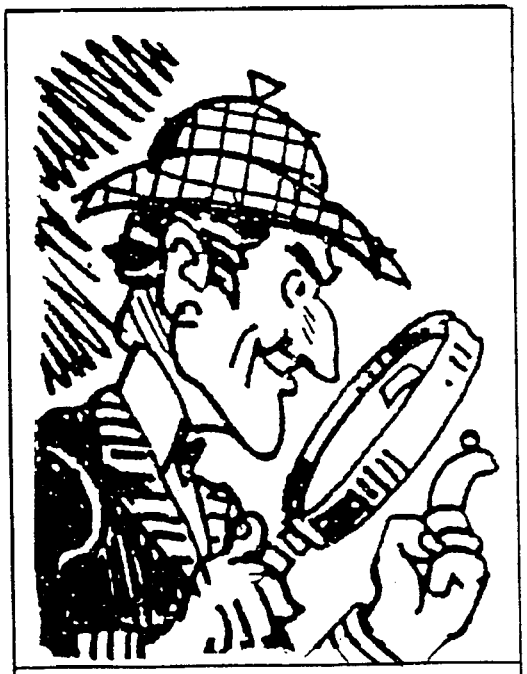
FIG. 47, "REVIEW CAREFULLY" (action)
Figure 48:
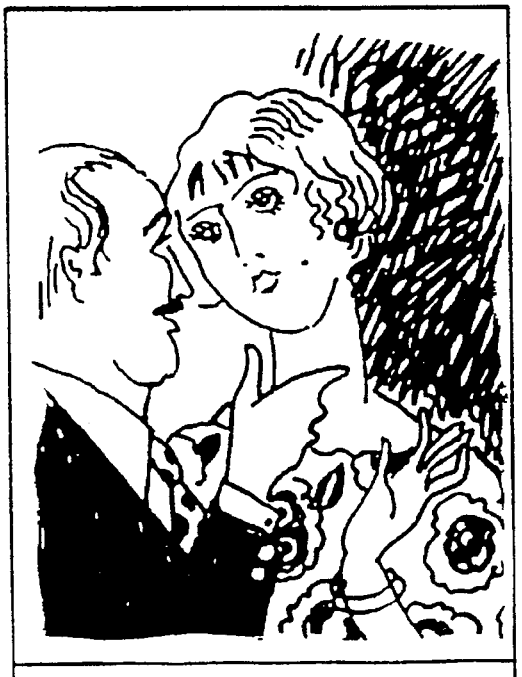
FIG. 48, "TALKING IT OVER" (action)
Figure 49:
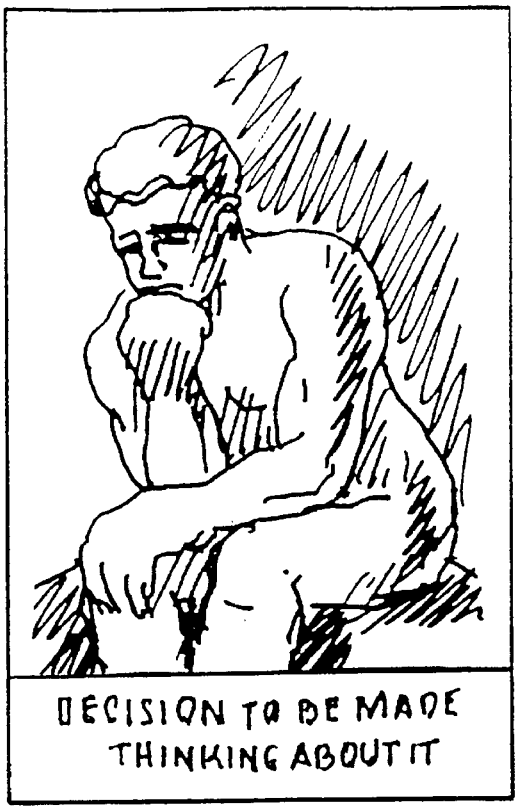
FIG. 49, "DECISION TO BE MADE/THINKING ABOUT IT" (action)
Figure 50:
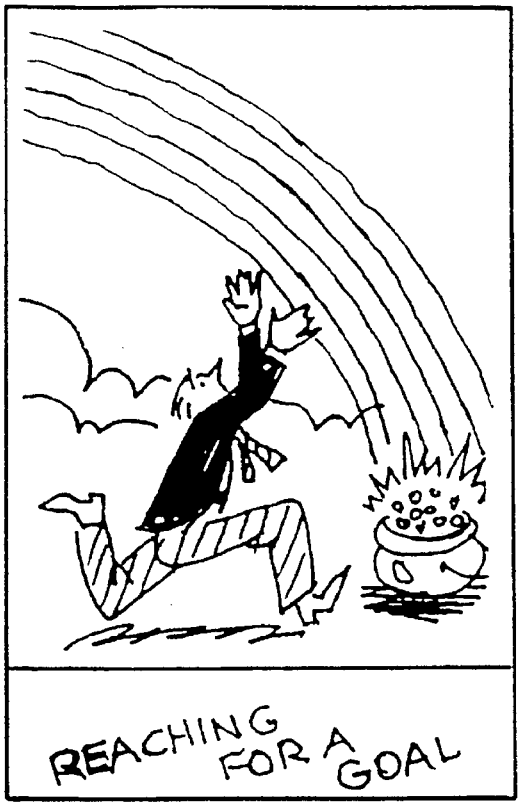
FIG. 50, "REACHING FOR A GOAL" (action)
Figure 51:
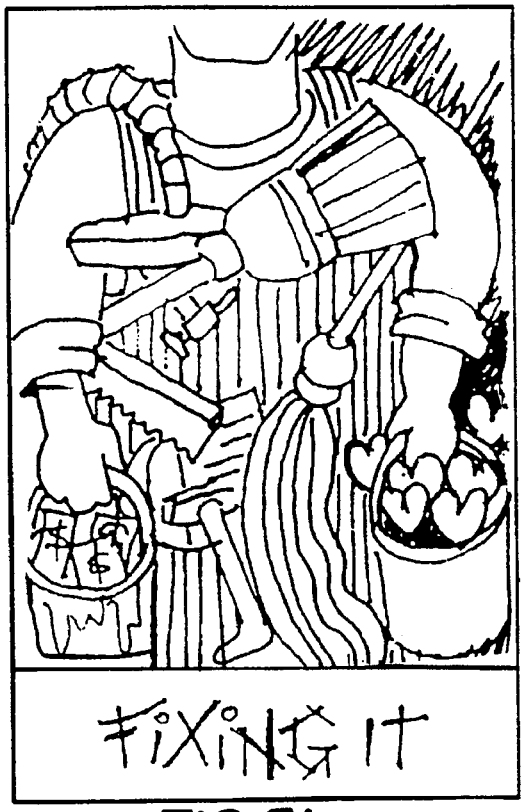
FIG. 51, "FIXING IT" (action)
Figure 52:
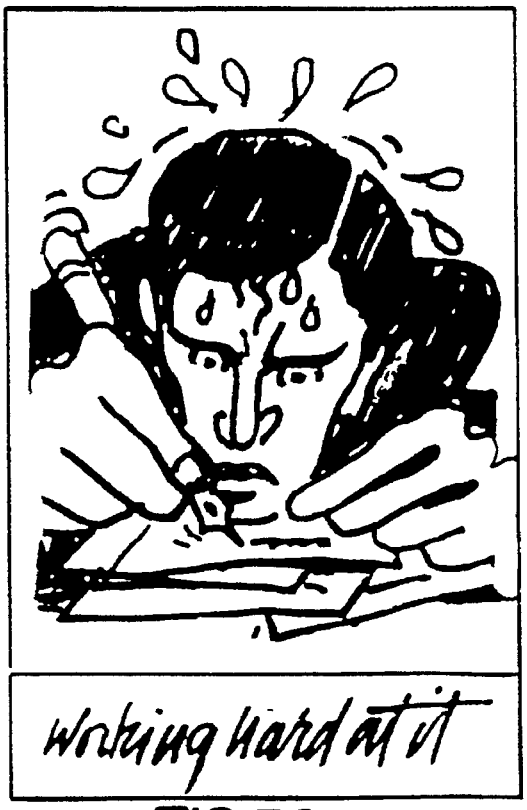
FIG. 52, "WORKING HARD AT IT" (action)
Figure 53:
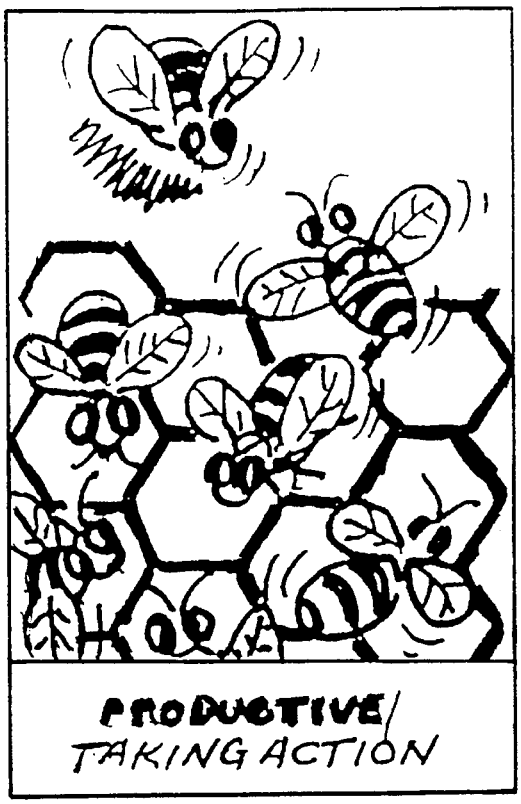
FIG. 53, "PRODUCTIVE/TAKING ACTION" (action)
Figure 54:
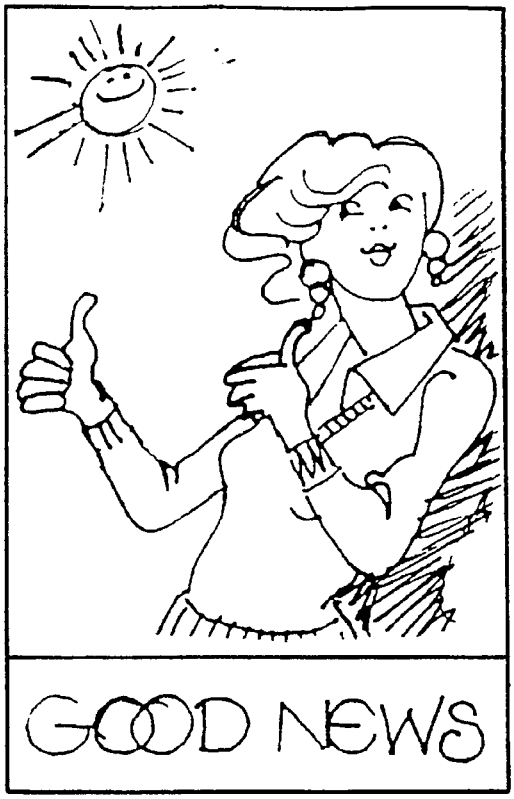
FIG. 54, "GOOD NEWS" (external)
Figure 55:
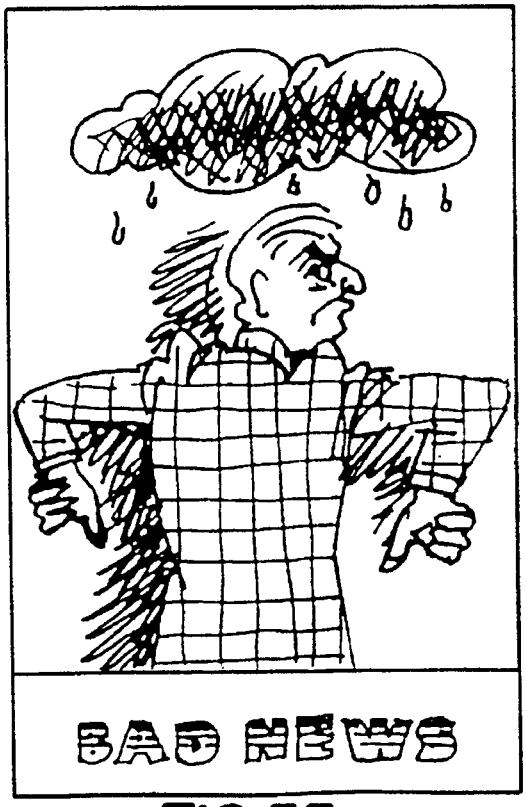
FIG. 55, "BAD NEWS" (external)
Figure 56:
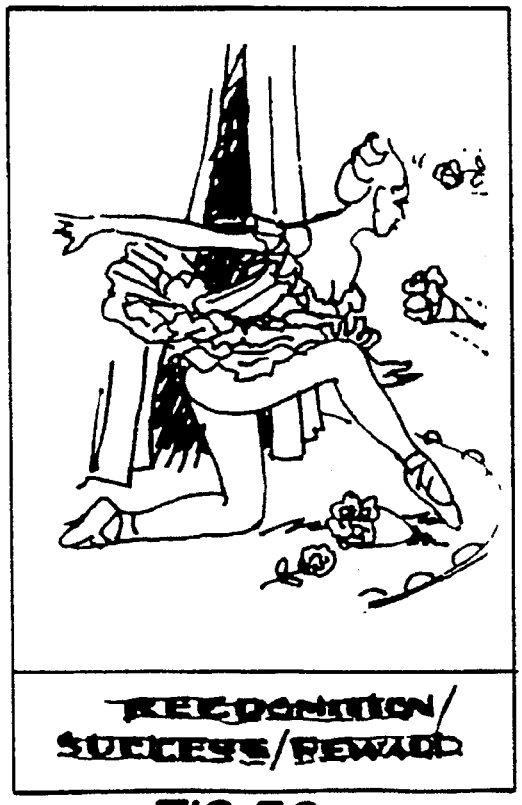
FIG. 56, "RECOGNITION/SUCCESS/REWARD" (result)
Figure 57:
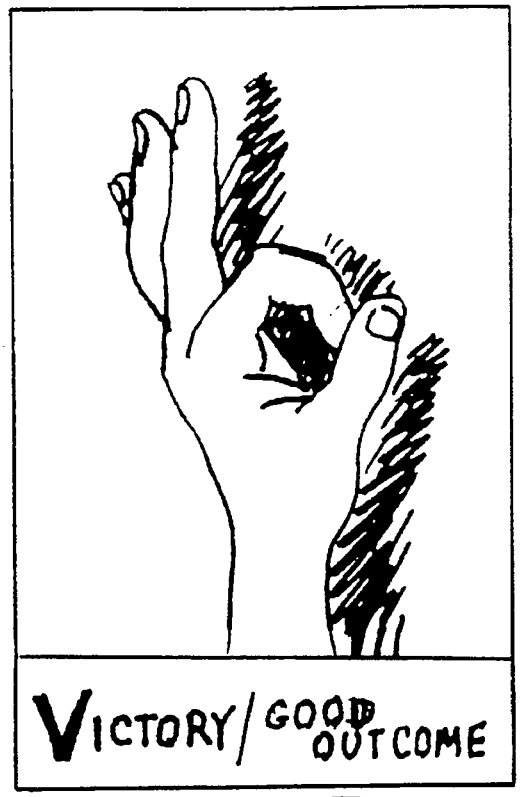
FIG. 57, "VICTORY/GOOD OUTCOME" (result)
Figure 58:
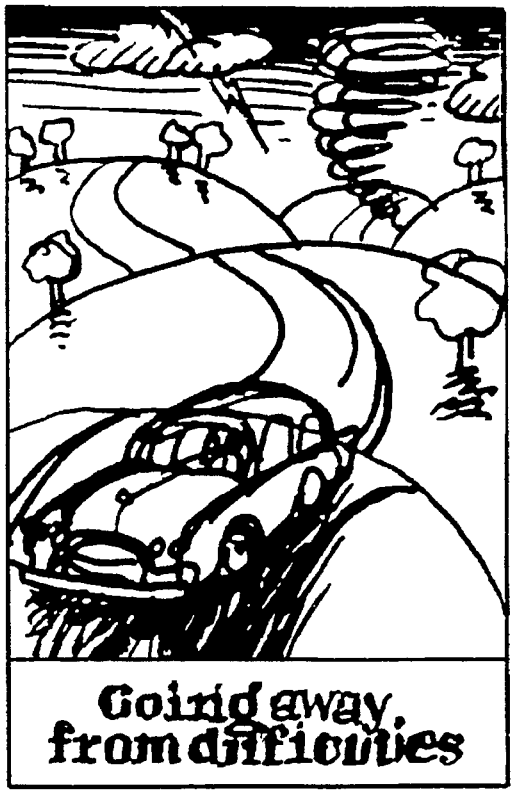
FIG. 58, "GOING AWAY FROM DIFFICULTIES" (result)
Figure 59:
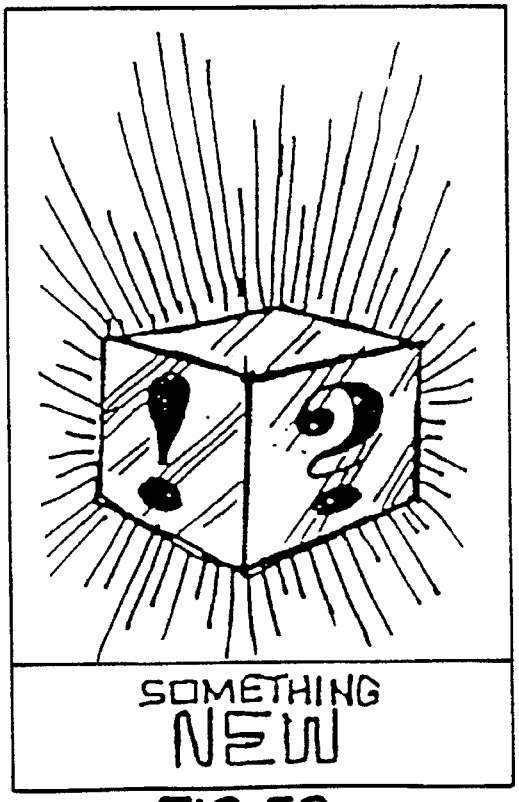
FIG. 59, "SOMETHING NEW" (external)
Figure 60:
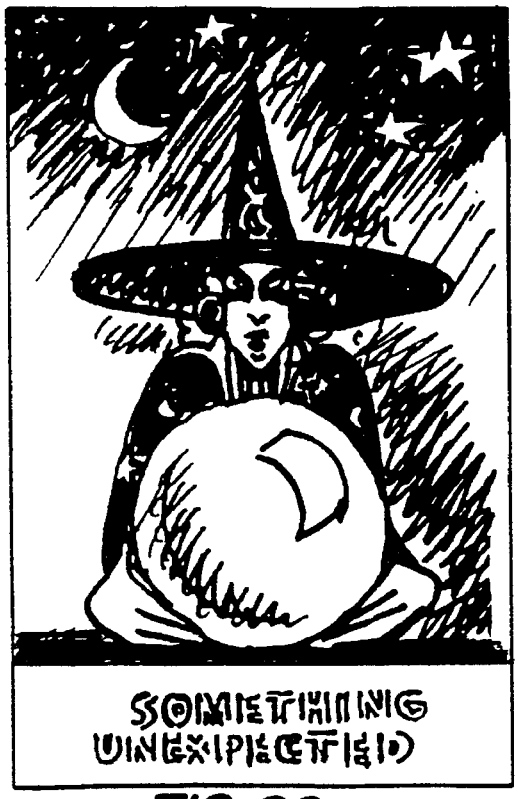
FIG. 60, "SOMETHING UNEXPECTED" (external)
Figure 61:
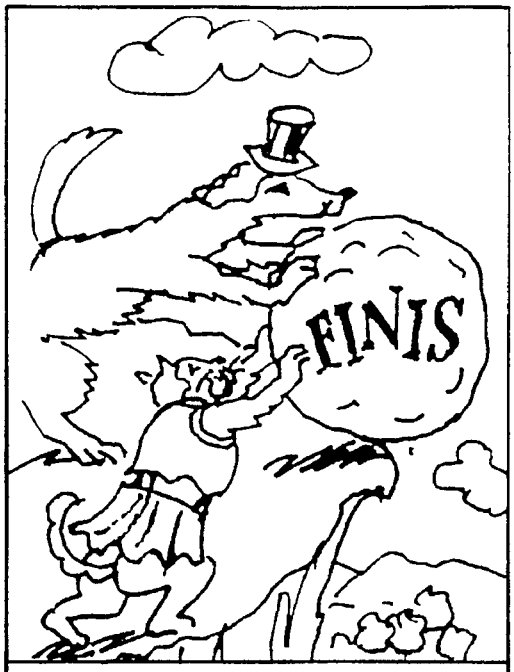
FIG. 61, "SOMETHING ENDING" (external)
Figure 62:
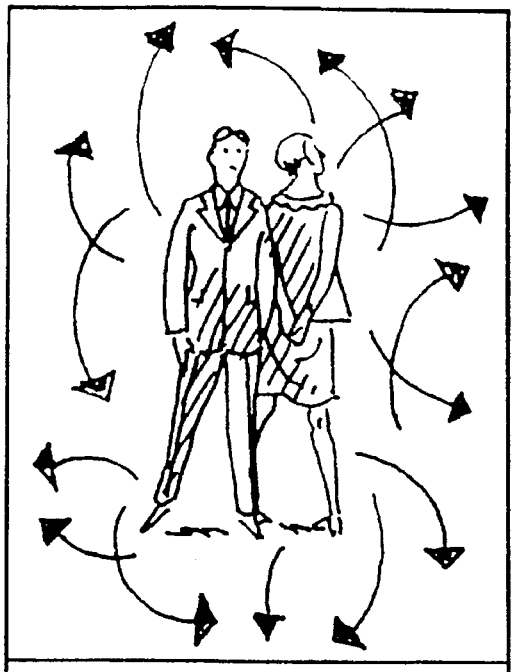
FIG. 62, "CHANGINGDIRECTIONS/VIEWPOINTS/GOALS" (action)
Figure 63:
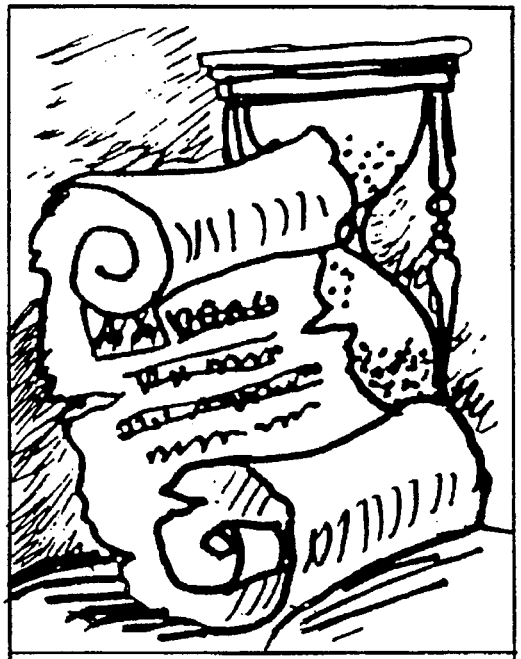
FIG. 63, "OLD SITUATION FROM THE PAST" (external)
Figure 64:
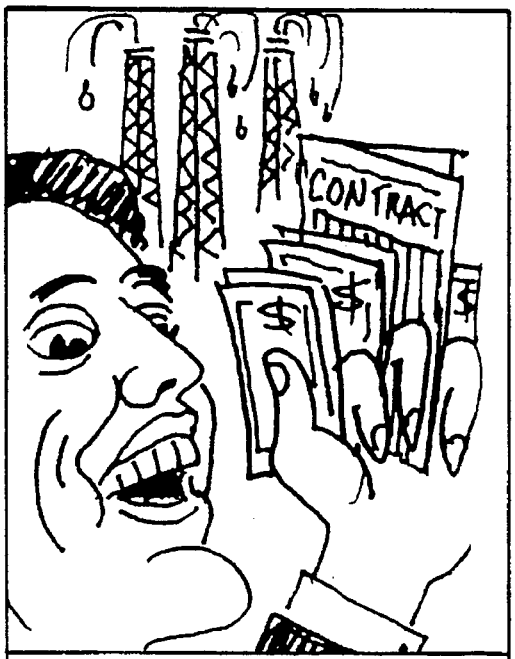
FIG. 64, "CAREER/BUSINESS/ENTERPRISE (GOOD OR NEW)" (result)

Other than the time cards of FIGS. 21–23, other measurement cards measure distance such as the card of FIG. 24 which indicates a long distance away and the card of FIG. 25 which indicates a close to home distance.

The deck also includes a wide variety of human condition cards which signify internal conditions such as emotions, attitudes and the like. These are grouped in the cards of FIGS. 26–38 and 40–44, 62 and 68. Personal action cards include those shown in FIGS. 45–53 and 67, 75, 79–81.

External influences or conditions are illustrated in the cards of FIGS. 54–55, 59–61, 63, 66, 68, 73 and 94–99. Cards which depict results include those shown in FIGS. 75–84, 56–58, 64–65, 69–72, 74, 76–78, 82–93.

Figure 65:
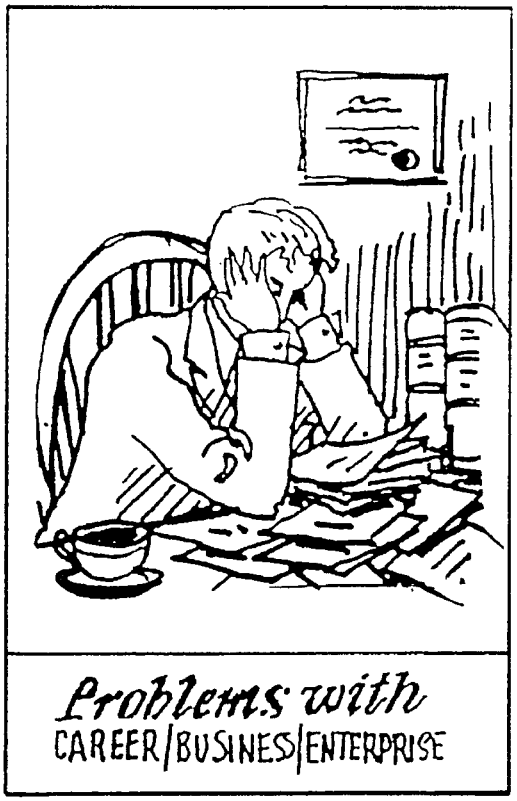
FIG. 65, "PROBLEMS WITH CAREER/BUSINESS/ENTERPRISE" (result)
Figure 66:
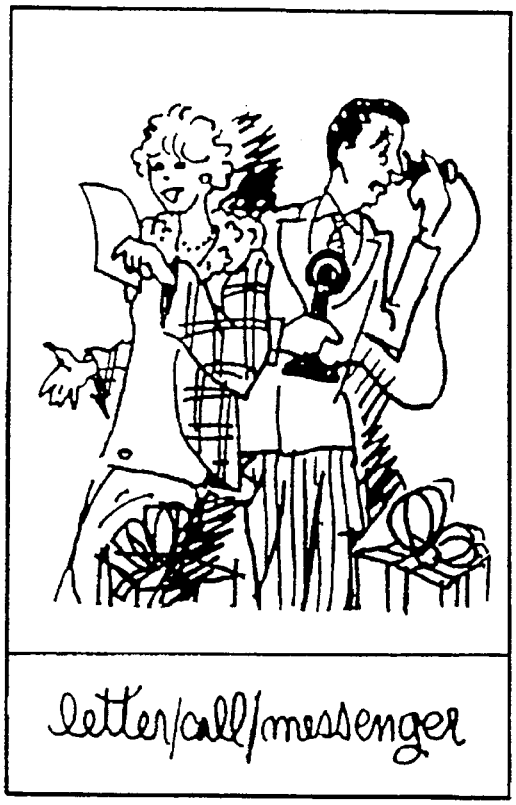
FIG. 66, "LETTER/CALL/MESSENGER" (external)
Figure 67:
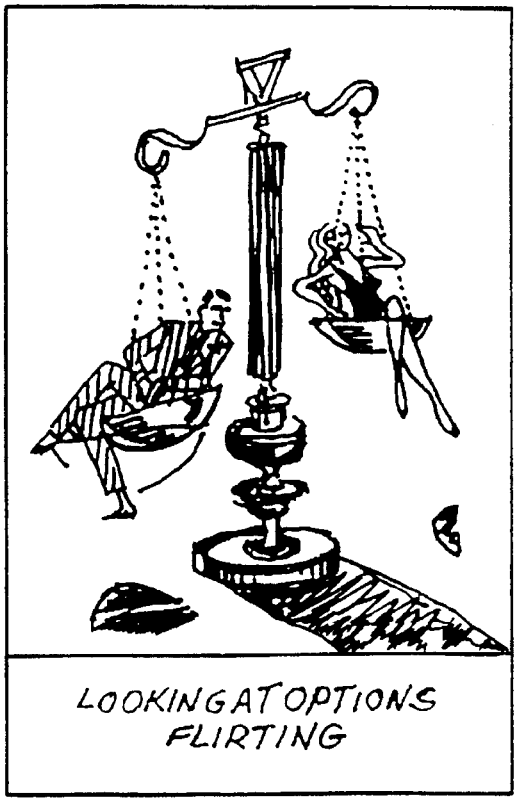
FIG. 67, "LOOKING AT OPTIONS/FLIRTING" (action)
Figure 68:
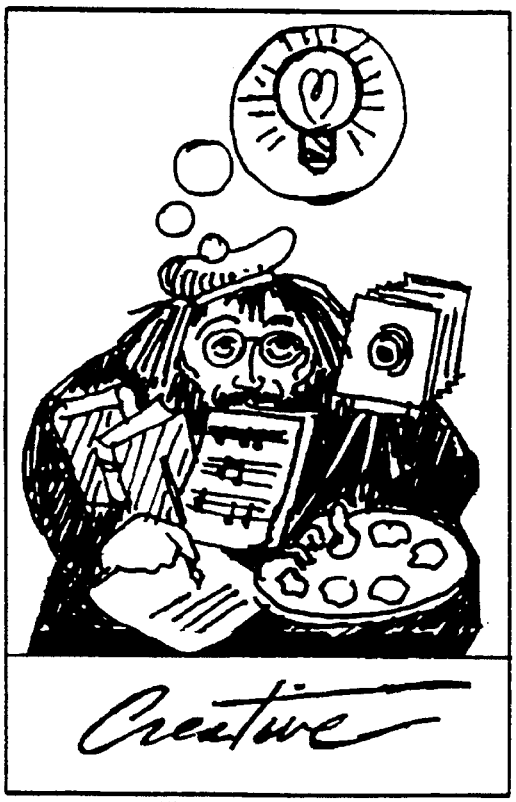
FIG. 68, "CREATIVE" (emotion)
Figure 69:
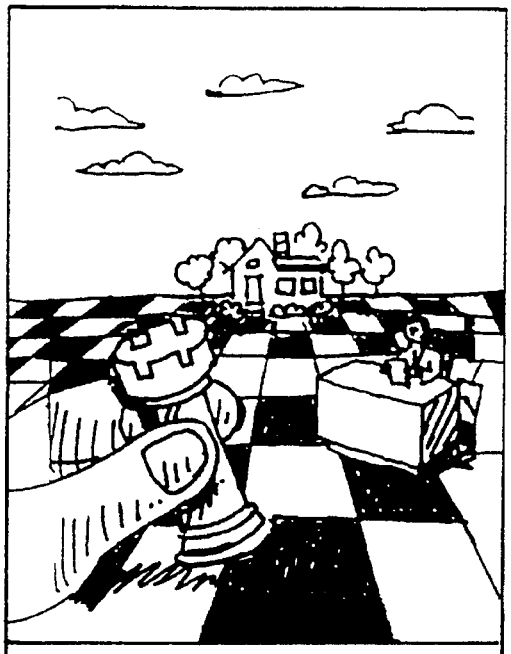
FIG. 69, "CHANGE OF HOME/CAREER/PLACE" (result)
Figure 70:
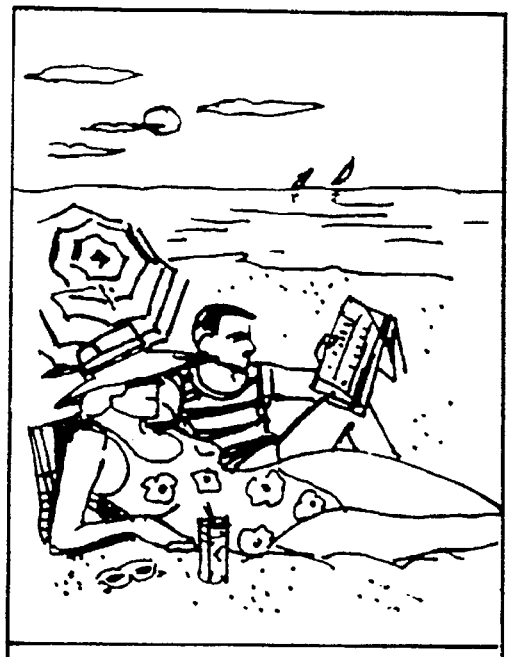
FIG. 70, "VACATION/LEISURE" (result)
Figure 71:
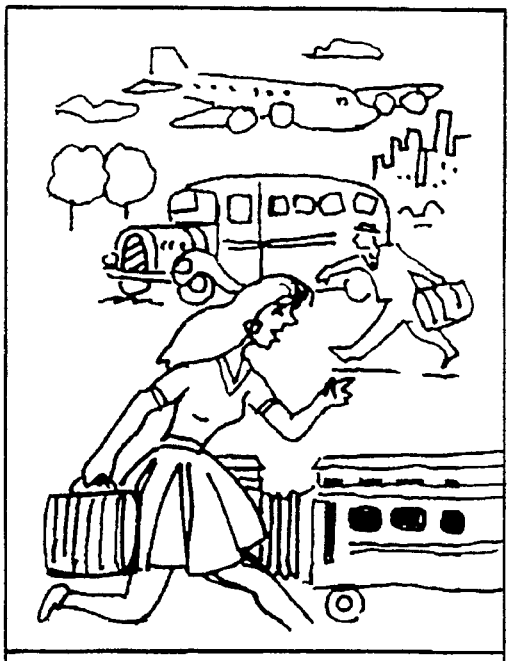
FIG. 71, "TRAVEL" (result)
Figure 72:
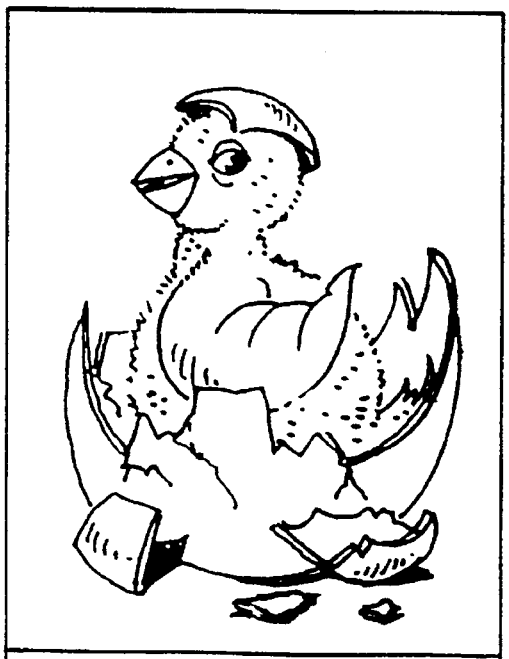
FIG. 72, "FERTILITY/PREGNANCY/A NEW IDEA" (result)
Figure 73:
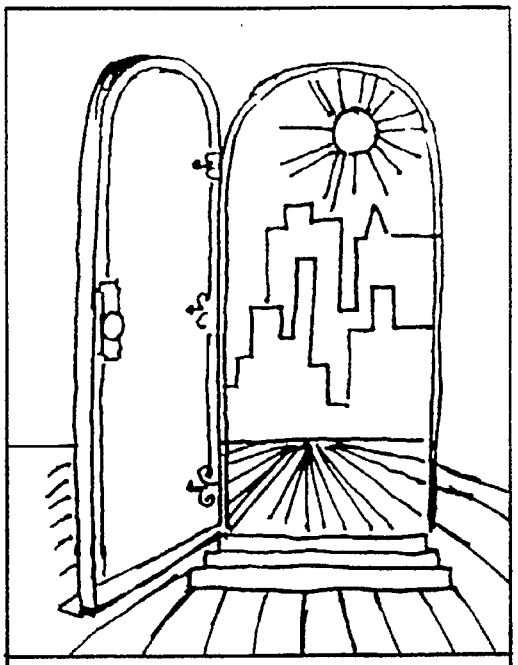
FIG. 73, "NEW OPPORTUNITY-ANOTHER CHANCE" (external)
Figure 74:
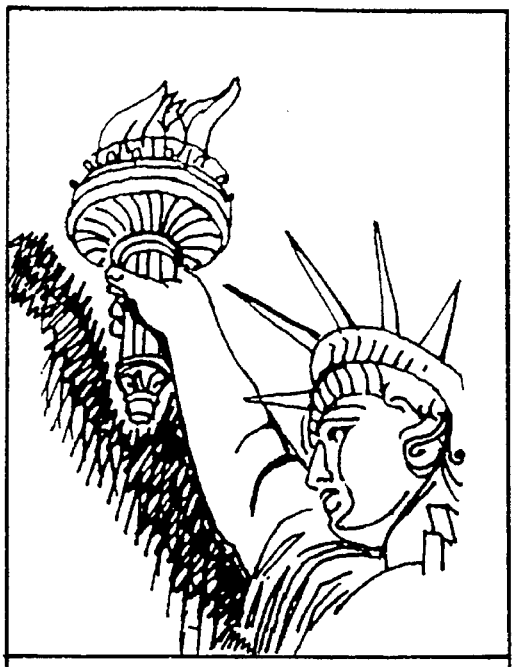
FIG. 74, "LIBERATION/FREEDOM" (result)
Figure 75:
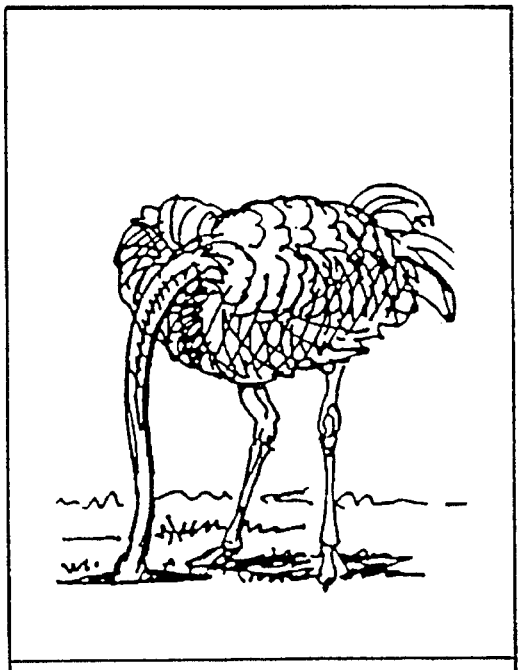
FIG. 75, "RETREATING" (action)
Figure 76:
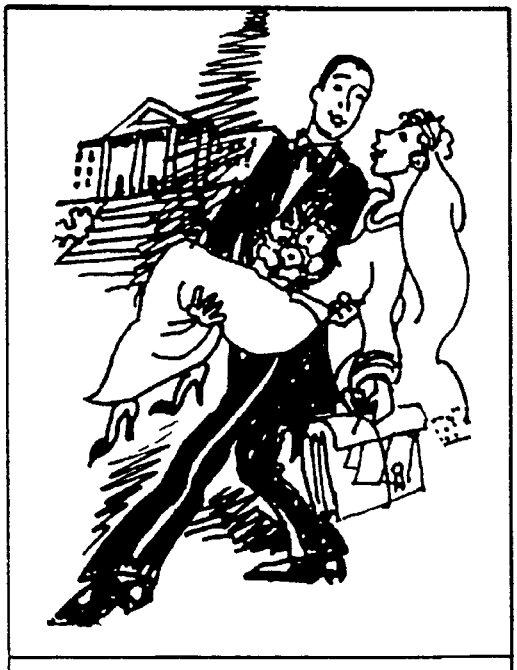
FIG. 76, "MARRIAGE AND/OR COMMITMENT" (result)
Figure 77:
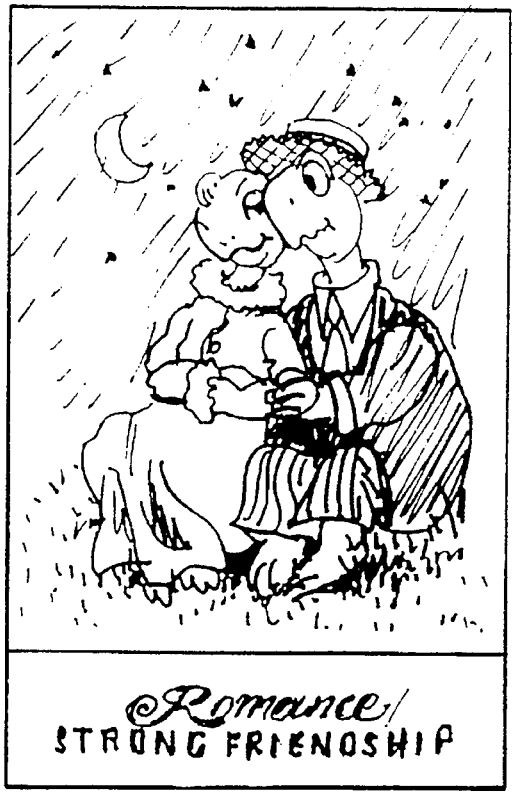
FIG. 77, "ROMANCE/STRONG FRIENDSHIP" (result)
Figure 78:
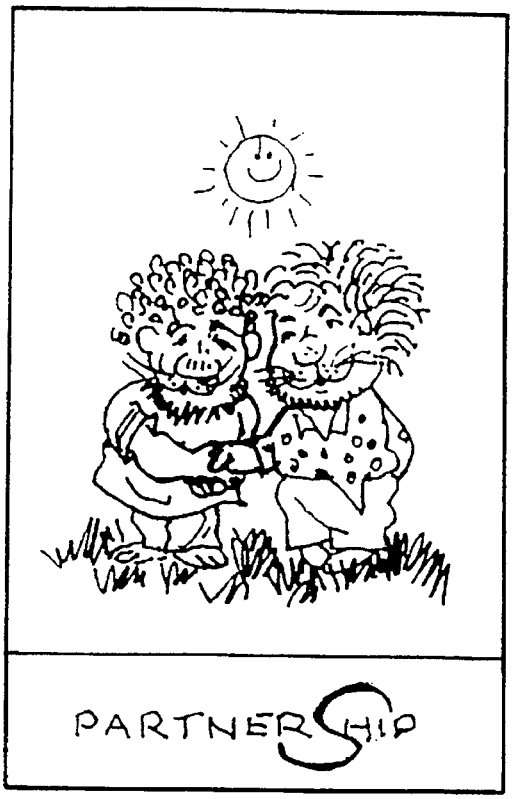
FIG. 78, "PARTNERSHI P" (result)
Figure 79:
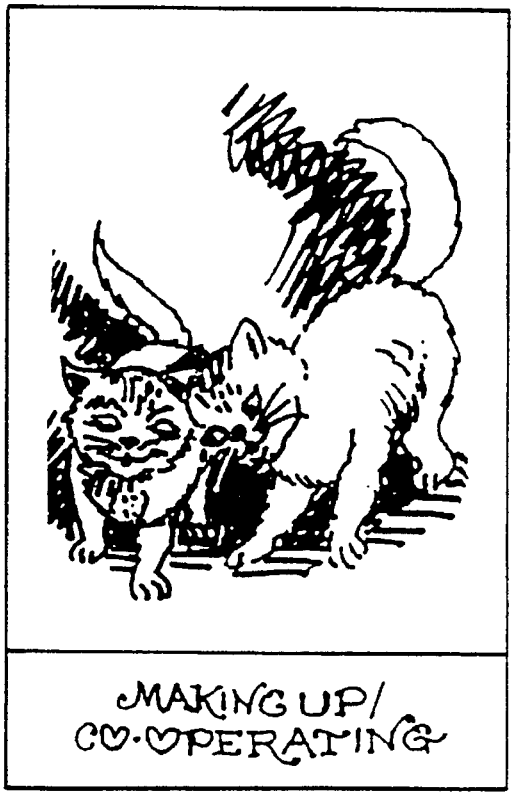
FIG. 79, "MAKING UP/COOPERATING" (action)
Figure 80:
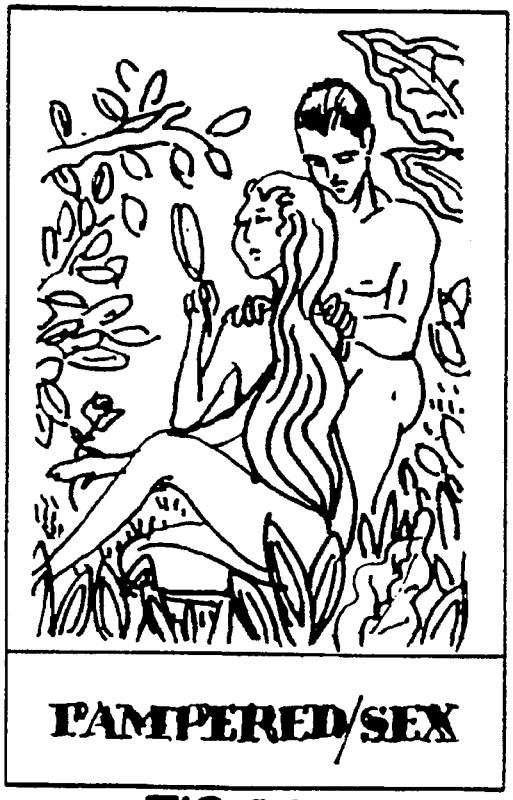
FIG. 80, "PAMPERED/SEX" (action)
Figure 81:
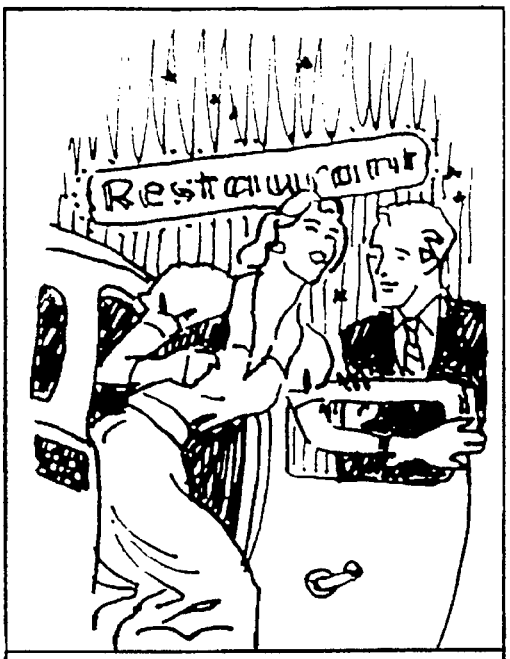
FIG. 81, "SOCIALIZING/GOING OUT/A DATE" (action)
Figure 82:
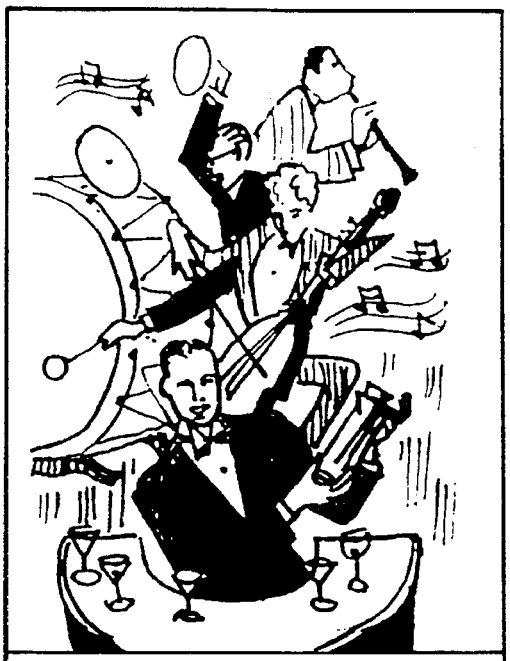
FIG. 82, "ENTERTAINMENT/HOSPITALITY" (result)
Figure 83:
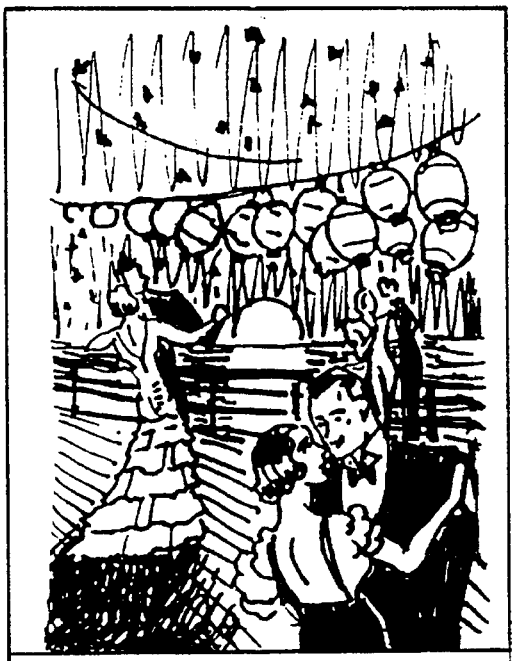
FIG. 83, "CELEBRATION/PARTY" (result)
Figure 84:
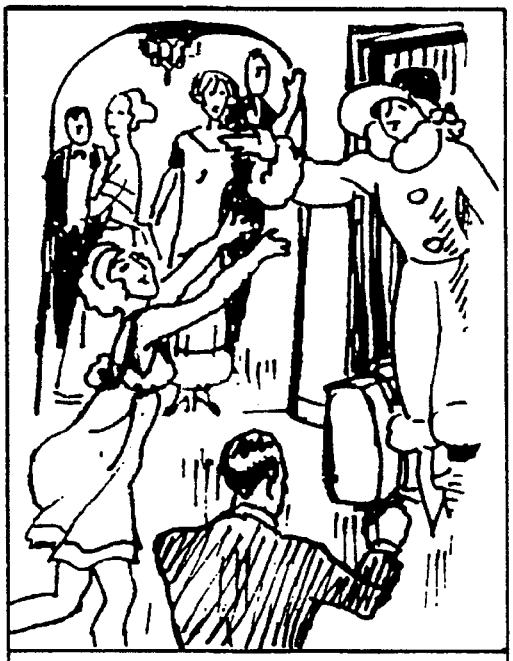
FIG. 84, "REUNION" (result)
Figure 85:
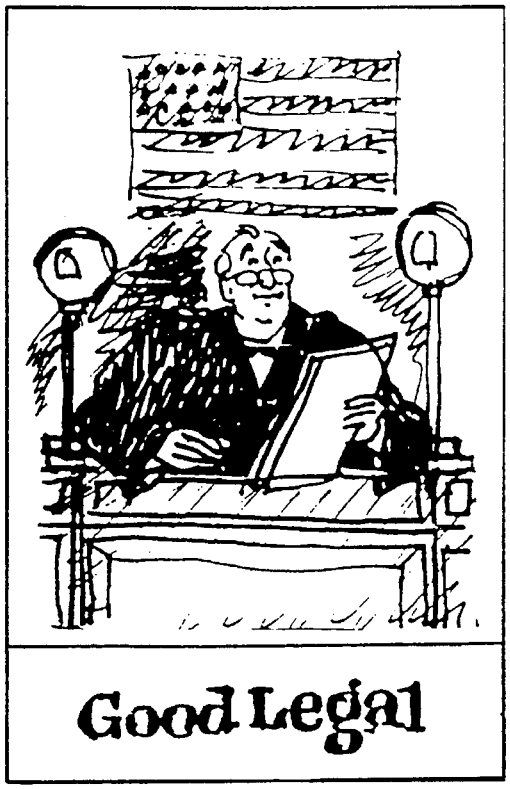
FIG. 85, "GOOD LEGAL" (result)
Figure 86:
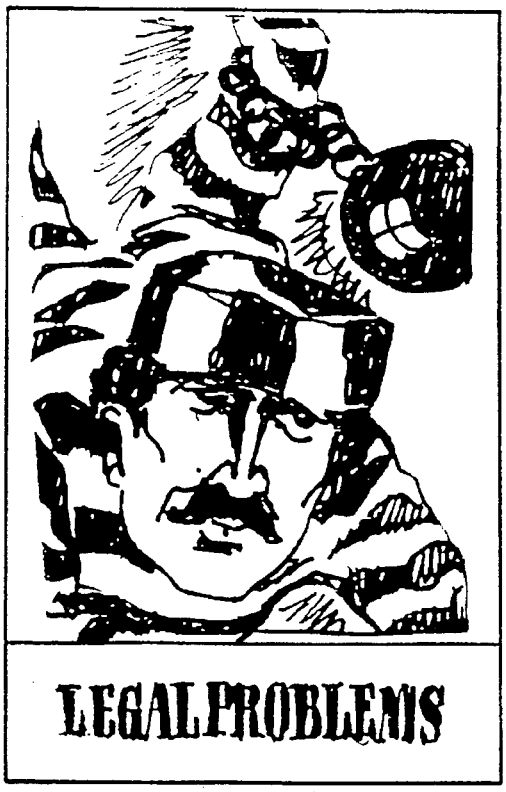
FIG. 86, "LEGAL PROBLEMS" (result)
Figure 87:
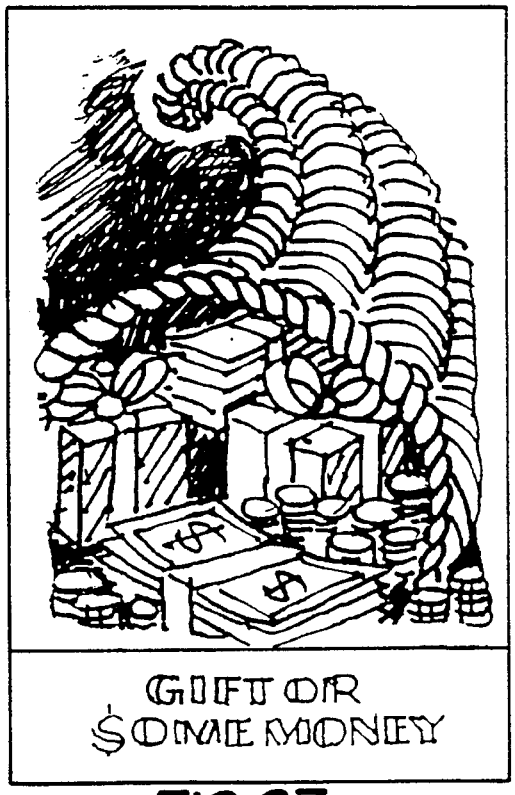
FIG. 87, "GIFT OR SOME MONEY" (result)
Figure 88:
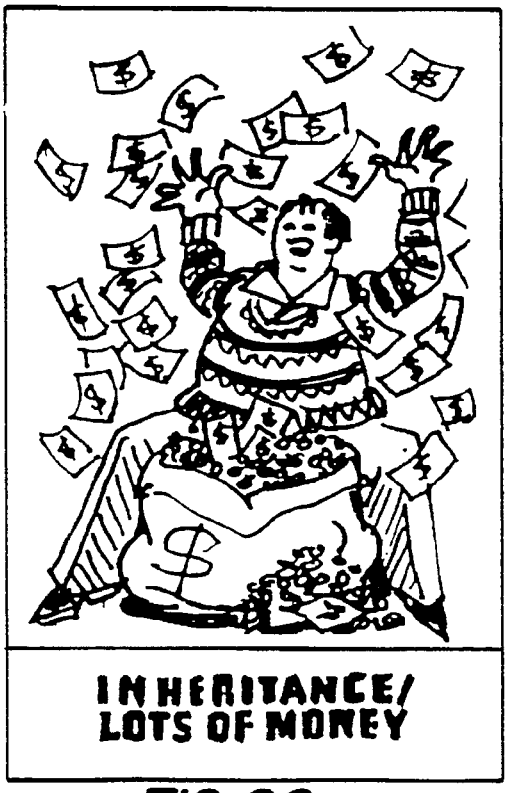
FIG. 88, "INHERITANCE/LOTS OF MONEY" (result)
Figure 89:
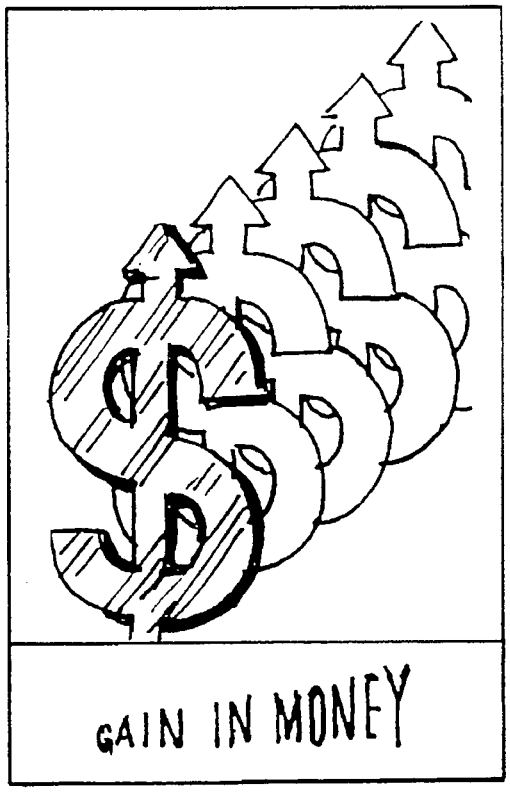
FIG. 89, "GAIN IN MONEY" (result)
Figure 90:
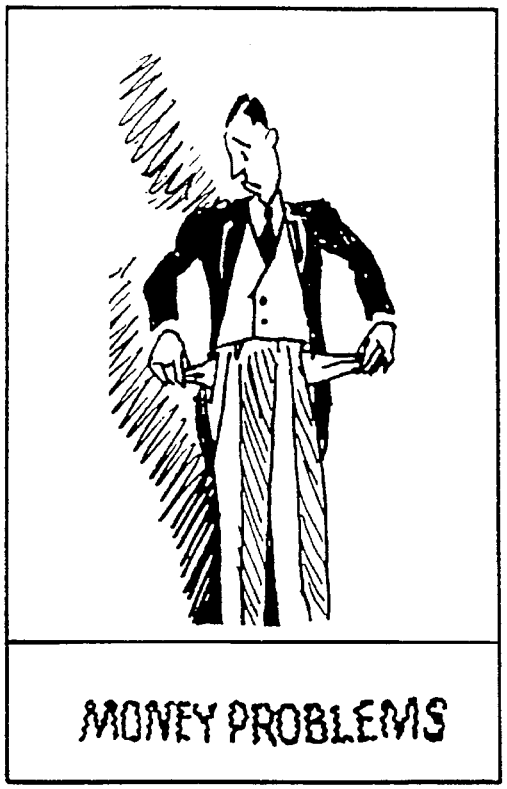
FIG. 90, "MONEY PROBLEMS" (result)
Figure 91:
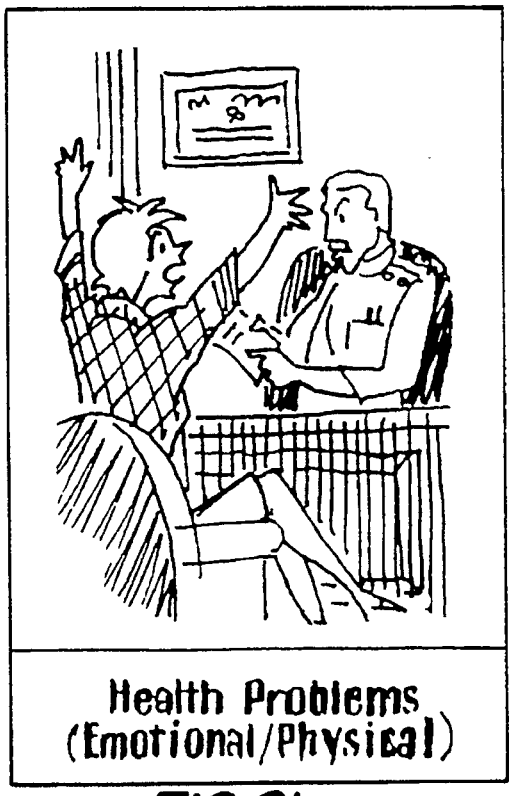
FIG. 91, "HEALTH PROBLEMS (EMOTIONAL/PHYSICAL)" (result)
Figure 92:
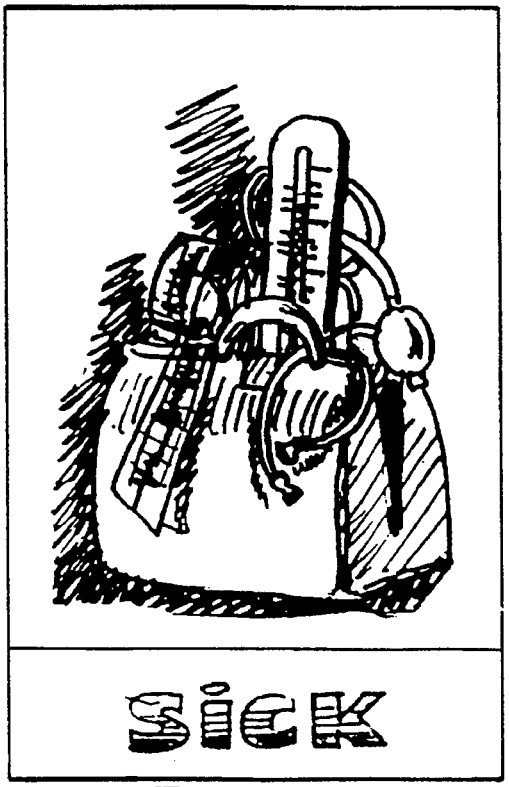
FIG. 92, "SICK" (result)
Figure 93:
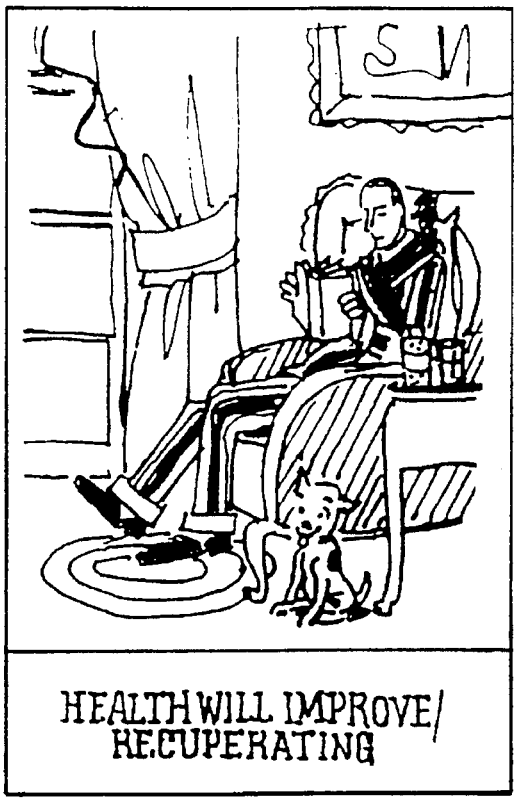
FIG. 93, "HEALTH WILL IMPROVE/RECUPERATING" (result)
Figure 94:
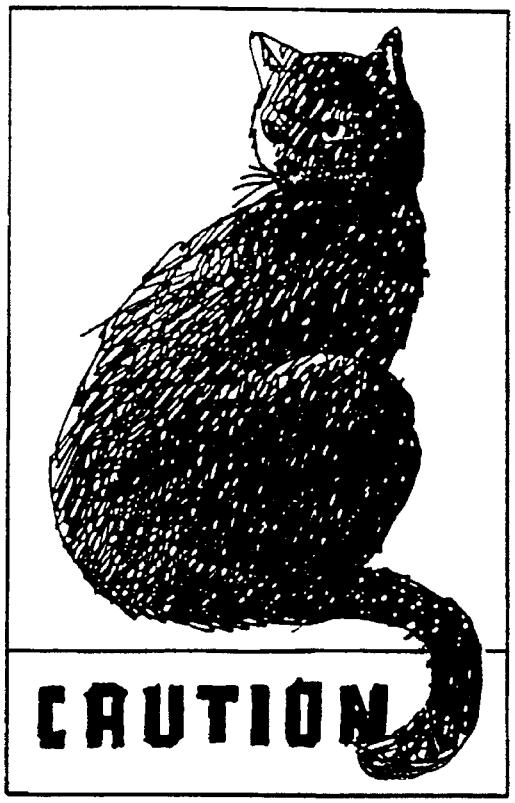
FIG. 94, "CAUTION"
Figure 95:
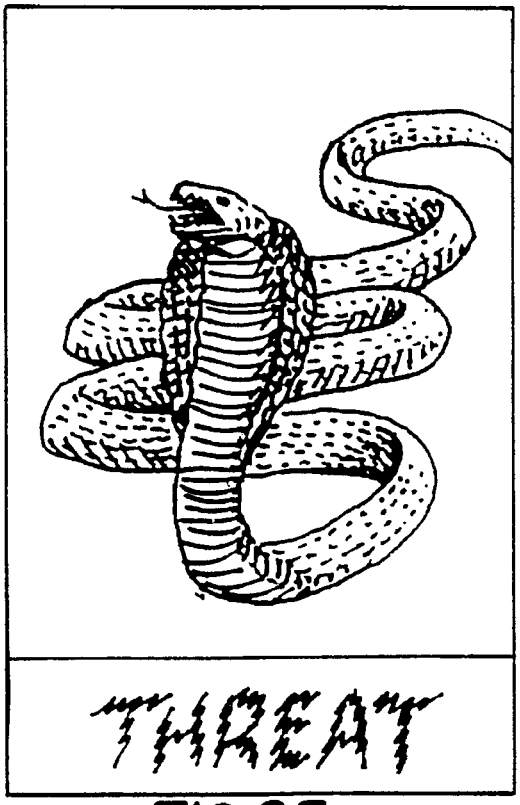
FIG. 95, "THREAT"
Figure 96:
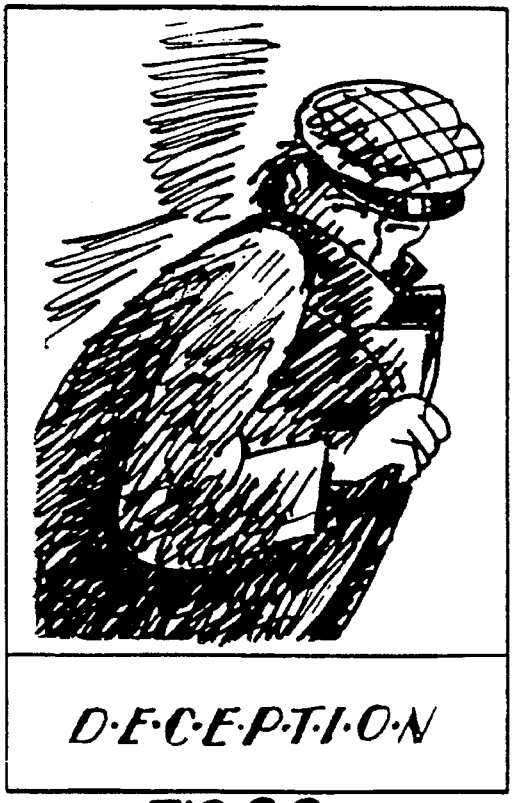
FIG. 96, "DECEPTION"
Figure 97:
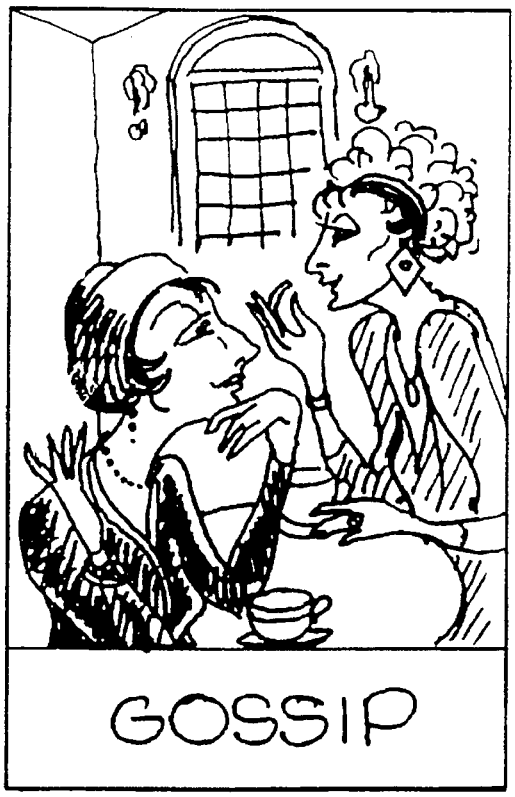
FIG. 97, "GOSSIP"
Figure 98:
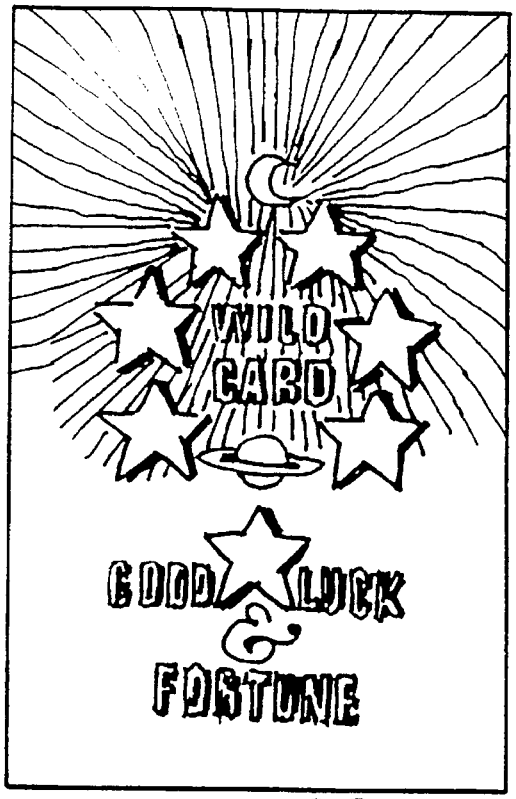
FIG. 98, "GOOD LUCK AND FORTUNE"
Figure 99:
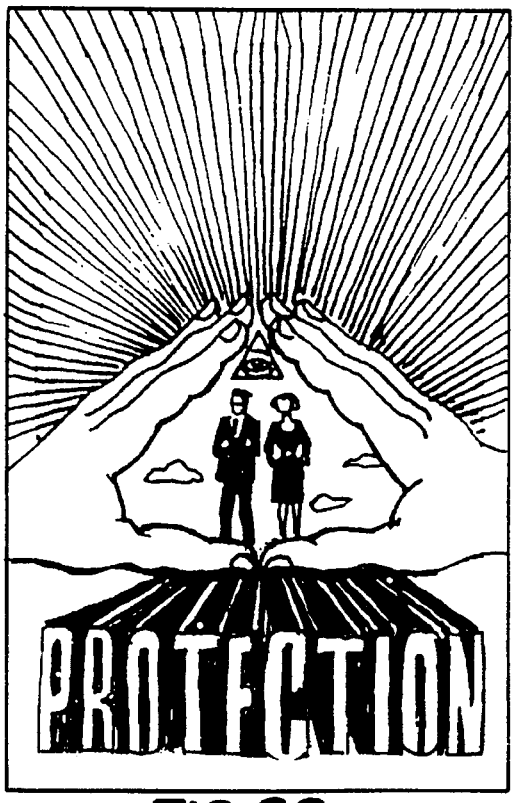
FIG. 99, "PROTECTION"

Rather than repeating the various emotions, conditions, influences and the like, reference is made to the drawings, where, through both images and words, the significance of the cards are apparent. Some of the figure descriptions indicate what type of card is involved, however, some cards overlap and are both action and result cards like FIGS. 72, 78, 82 and 83, while other overlap cards are both result and emotion or condition cards like FIGS. 76 and 77. FIGS. 65 and 70 overlap result and external influence cards. Other overlaps also exist.

Some of the cards are relationship cards like FIGS. 79 and 81, but here again, these can overlap.

The cards are advantageously plastic or plastic coated so that any writing can be removed without damage to the deck of cards.

To play, a person writes in the names of people he or she wants to know about, including the person's own name on one card. Then that person writes in the question he or she wants answered on the question card. The person need not do these first two steps, or he or she can choose only one person card, one's own, or as many people cards as he or she wants to include in the game. The 18 people cards includes images of different genders, hair color, different looks, ages and body language positions so that the person selects a card he or she wants either based on actual character or on desired or perceived character.

The cards are then shuffled very well for first time users and thereafter, shuffled while thinking about what that individual wants to know.

The cards are cut with the person's left hand, if he or she is reading his or herself, or have the person he or she is reading for cut with their left hand. If the person wants to know about another person's future, and that person is not present to cut the cards his or herself, he or she can ask a question about someone else and then cut the cards for that person, by cutting the deck with his or her right hand.

The cards are then put together and spread out any old way, and with his or her left or right hand, five to ten cards are picked and turned up. The cards are reviewed and the meanings are put together as he or she sees them.

If the individual wants more information (or clarification) on any issue or card, more cards are picked until he or she feels has the answer. If the person is using the "QUESTION IS" card, and has a specific question, the card is laid down first, and cards are picked and placed below this card until he or she gets the answer.

The person can use the people cards, by putting one down first, before he or she shuffles the rest of the deck, and chooses cards below this card until the person has his or her answer about his or herself or another person. Or the person can put two people cards down at first, and pick cards that relate to these two people.

The individual can pick one or three cards, or how ever many cards he or she wants, for any day or any issue or question. The individual can also make-up his or her own special rules to laying out cards, as long as the individual figures out his or her rules before he or she shuffles (or anyone else) the cards.

Among the various cards, note that the "SOMETHING ENDING" card (FIG. 61) is not only something good ending, it could be something bad ending. The "MARRIAGE AND/OR COMMITMENT" card (FIG. 76) can be a commitment to anything, not only marriage. "FERTILITY/PREGNANCY/A NEW IDEA" card (FIG. 72) can be a new idea or concept for oneself and not only pregnancy, or fertility. The "PROTECTION" card (FIG. 99) protects any other cards around it or any issue or question being as negative as it might otherwise be. This card supersedes any other card. The "SICK" card (FIG. 92) could be as non-threatening as a cold.

If an individual is very anxious about something and consults the cards, sometimes that person will get a false reading. It is best to have someone else read that person's cards then.

By practicing the game of the invention, the individuals involved are entertained and also gain an insight into their own feelings and personal situations, and perhaps even their future fate, although a supernatural quality is not claimed for the invention.

While a specific embodiment of the invention has been shown and described in detail to illustrate the application of the principles of the invention, it will be understood that the invention may be embodied otherwise without departing from such principles.

What is claimed is:

1. A method of playing a fortune telling card game comprising:

providing a deck of cards having eighteen people cards, each people card containing indicia depicting an individual, each people card having a name area below the indicia for removably writing a name, one of the people cards being for representing a person whose fortune is to be entertainingly told with the deck of cards, the remaining people cards being for representing other people involved in the fortune;

selecting one of the people card that resemble the person whose fortune is to be entertainingly told;

writing the name of the person whose fortune is to be entertainingly told onto the name area of the selected people card;

further including in the deck of cards: a second plurality of internal condition cards each containing indicia depicting a human emotion or attitude; a third plurality of quantity cards each containing indicia depicting a quantity of time and distance, there being three time cards for three time periods of different lengths and two distance cards for two different distances; a fourth plurality of relationship cards each containing indicia depicting a human relationship; a fifth plurality of external influence or condition cards, each containing indicia depicting an external influence or condition; a sixth plurality of action or interaction cards each containing indicia depicting a human action or interaction; a seventh plurality of result cards each containing indicia depicting a result or outcome; and at least one question card having an area on which a question is depicted;

writing a question onto the question card;

shuffling together at least some of the internal condition cards, the quantity cards, the relationship cards, the external influence or condition cards, the action or interaction cards and the result cards;

placing the shuffled cards face down;

turning over a selected number of the cards that have been placed face down to show the turned over cards: and entertainingly telling the fortune of the person whose fortune is to be told, using the turned over cards.

2. A method according to claim 1, including providing the people cards to each contain a different image of a person having a selected gender and age range, for selecting the one people card which resembles the person whose fortune is to be told.

3. A method according to claim 1, including providing the seventh plurality of cards to include at least one card depicting a happy couple and at least one card depicting a family or friend group of people.

* * * * *